US008434573B2

(12) United States Patent
Hall et al.

(10) Patent No.: US 8,434,573 B2
(45) Date of Patent: May 7, 2013

(54) DEGRADATION ASSEMBLY

(75) Inventors: David R. Hall, Provo, UT (US); Ronald B. Crockett, Payson, UT (US); Scott Dahlgren, Alpine, UT (US)

(73) Assignee: Schlumberger Technology Corporation, Houston, TX (US)

( * ) Notice: Subject to any disclaimer, the term of this patent is extended or adjusted under 35 U.S.C. 154(b) by 471 days.

(21) Appl. No.: 12/536,695

(22) Filed: Aug. 6, 2009

(65) Prior Publication Data

US 2009/0294182 A1 Dec. 3, 2009

Related U.S. Application Data

(63) Continuation of application No. 12/051,738, filed on Mar. 19, 2008, now Pat. No. 7,669,674, which is a continuation of application No. 12/051,689, filed on Mar. 19, 2008, now Pat. No. 7,963,617, which is a continuation-in-part of application No. 12/051,586, (Continued)

(51) Int. Cl.
*E21B 10/46* (2006.01)

(52) U.S. Cl.
USPC ..... 175/432; 175/434

(58) Field of Classification Search ..... 175/426, 175/428, 430, 434, 435, 432
See application file for complete search history.

(56) References Cited

U.S. PATENT DOCUMENTS 465,103 A 12/1891 Wegner
616,118 A 12/1898 Kunhe (Continued)

FOREIGN PATENT DOCUMENTS

DE 3 307 910 9/1984
DE 3 500 261 7/1986

(Continued)

OTHER PUBLICATIONS

Chaturvedi et al., Diffusion Brazing of Cast Inconel 738 Superalloy, Sep. 2005, Journal of Materials Online (http://www.azom.com/details.asp?ArticleID=2995).

(Continued)

*Primary Examiner* — John Kreck
(74) *Attorney, Agent, or Firm* — Osha Liang LLP

(57) ABSTRACT

In one aspect of the invention, a tool has a working portion with at least one impact tip brazed to a carbide extension. The carbide extension has a cavity formed in a base end and is adapted to interlock with a shank assembly of the cutting element assembly. The shank assembly has a locking mechanism adapted to interlock a first end of the shank assembly within the cavity. The locking mechanism has a radially extending catch formed in the first end of the shank assembly. The shank assembly has an outer surface at a second end of the shank assembly adapted to be press-fitted within a recess of a driving mechanism. The outer surface of the shank assembly has a coefficient of thermal expansion of 110 percent or more than a coefficient of thermal expansion of a material of the driving mechanism.

18 Claims, 11 Drawing Sheets

Related U.S. Application Data filed on Mar. 19, 2008, now Pat. No. 8,007,050, which is a continuation-in-part of application No. 12/021,051, filed on Jan. 28, 2008, which is a continuation of application No. 12/021,019, filed on Jan. 28, 2008, which is a continuation-in-part of application No. 11/971,965, filed on Jan. 10, 2008, now Pat. No. 7,648,210, which is a continuation of application No. 11/947,644, filed on Nov. 29, 2007, now Pat. No. 8,007,051, which is a continuation-in-part of application No. 11/844,586, filed on Aug. 24, 2007, now Pat. No. 7,600,823, which is a continuation-in-part of application No. 11/829,761, filed on Jul. 27, 2007, now Pat. No. 7,722,127, which is a continuation-in-part of application No. 11/773,271, filed on Jul. 3, 2007, now Pat. No. 7,997,661, which is a continuation-in-part of application No. 11/766,903, filed on Jun. 22, 2007, which is a continuation of application No. 11/766,865, filed on Jun. 22, 2007, which is a continuation-in-part of application No. 11/742,304, filed on Apr. 30, 2007, now Pat. No. 7,475,948, which is a continuation of application No. 11/742,261, filed on Apr. 30, 2007, now Pat. No. 7,469,971, which is a continuation-in-part of application No. 11/464,008, filed on Aug. 11, 2006, now Pat. No. 7,338,135, which is a continuation-in-part of application No. 11/463,998, filed on Aug. 11, 2006, now Pat. No. 7,384,105, which is a continuation-in-part of application No. 11/463,990, filed on Aug. 11, 2006, now Pat. No. 7,320,505, which is a continuation-in-part of application No. 11/463,975, filed on Aug. 11, 2006, now Pat. No. 7,445,294, which is a continuation-in-part of application No. 11/463,962, filed on Aug. 11, 2006, now Pat. No. 7,413,256, which is a continuation-in-part of application No. 11/463,953, filed on Aug. 11, 2006, now Pat. No. 7,464,993, application No. 12/536,695, which is a continuation-in-part of application No. 11/695,672, filed on Apr. 3, 2007, now Pat. No. 7,396,086, which is a continuation-in-part of application No. 11/686,831, filed on Mar. 15, 2007, now Pat. No. 7,568,770.

(56) References Cited

U.S. PATENT DOCUMENTS

| | | | |
|---|---|---|---|
| 946,060 | A | 1/1910 | Looker |
| 1,116,154 | A | 11/1914 | Stowers |
| 1,183,630 | A | 5/1916 | Bryson |
| 1,189,560 | A | 7/1916 | Gondos |
| 1,360,908 | A | 11/1920 | Everson |
| 1,387,733 | A | 8/1921 | Midgett |
| 1,460,671 | A | 7/1923 | Hebsacker |
| 1,544,757 | A | 7/1925 | Hufford et al. |
| 1,821,474 | A | 9/1931 | Mercer |
| 1,879,177 | A | 9/1932 | Gault |
| 2,004,315 | A | 6/1935 | Fean |
| 2,054,255 | A | 9/1936 | Howard |
| 2,064,255 | A | 12/1936 | Garfield |
| 2,124,438 | A | 7/1938 | Struk et al. |
| 2,169,223 | A | 8/1939 | Christian |
| 2,218,130 | A | 10/1940 | Court |
| 2,320,136 | A | 5/1943 | Kammerer |
| 2,466,991 | A | 4/1949 | Kammerer |
| 2,540,464 | A | 2/1951 | Stokes |
| 2,544,036 | A | 3/1951 | Kammerer |
| 2,755,071 | A | 7/1956 | Kammerer |
| 2,776,819 | A | 1/1957 | Brown |
| 2,819,043 | A | 1/1958 | Henderson |
| 2,838,284 | A | 6/1958 | Austin |
| 2,894,722 | A | 7/1959 | Buttolph |
| 2,901,223 | A | 8/1959 | Scott |
| 2,963,102 | A | 12/1960 | Smith |
| 3,135,341 | A | 6/1964 | Ritter |
| 3,254,392 | A | 6/1966 | Novkov |
| 3,294,186 | A | 12/1966 | Buell |
| 3,301,339 | A | 1/1967 | Pennebaker, Jr. |
| 3,379,264 | A | 4/1968 | Cox |
| 3,397,012 | A | 8/1968 | Krekeler |
| 3,429,390 | A | 2/1969 | Bennett |
| 3,493,165 | A | 2/1970 | Schonfeld |
| 3,583,504 | A | 6/1971 | Aalund |
| 3,626,775 | A | 12/1971 | Gentry |
| 3,745,396 | A | 7/1973 | Quintal et al. |
| 3,745,623 | A | 7/1973 | Wentorf, Jr. et al. |
| 3,746,396 | A | 7/1973 | Radd |
| 3,764,493 | A | 10/1973 | Rosar et al. |
| 3,800,891 | A | 4/1974 | White et al. |
| 3,807,804 | A | 4/1974 | Kniff |
| 3,821,993 | A | 7/1974 | Kniff et al. |
| 3,830,321 | A | 8/1974 | McKenry et al. |
| 3,932,952 | A | 1/1976 | Helton |
| 3,945,681 | A | 3/1976 | White |
| 3,955,635 | A | 5/1976 | Skidmore |
| 3,960,223 | A | 6/1976 | Kleine |
| 4,005,914 | A | 2/1977 | Newman |
| 4,006,936 | A | 2/1977 | Crabiel |
| 4,081,042 | A | 3/1978 | Johnson et al. |
| 4,096,917 | A | 6/1978 | Harris |
| 4,098,362 | A | 7/1978 | Bonnice |
| 4,106,577 | A | 8/1978 | Summers |
| 4,109,737 | A | 8/1978 | Bovenkerk |
| 4,140,004 | A | 2/1979 | Smith et al. |
| 4,156,329 | A | 5/1979 | Daniels et al. |
| 4,176,723 | A | 12/1979 | Arceneaux |
| 4,199,035 | A | 4/1980 | Thompson |
| 4,201,421 | A | 5/1980 | Den Besten |
| 4,211,508 | A | 7/1980 | Dill et al. |
| 4,224,380 | A | 9/1980 | Bovenkerk et al. |
| 4,253,533 | A | 3/1981 | Baker, III |
| 4,268,089 | A | 5/1981 | Spence et al. |
| 4,277,106 | A | 7/1981 | Sahley |
| 4,280,573 | A | 7/1981 | Sudnishnikov et al. |
| 4,304,312 | A | 12/1981 | Larsson |
| 4,307,786 | A | 12/1981 | Evans |
| D264,217 | S | 5/1982 | Prause et al. |
| 4,333,902 | A | 6/1982 | Hara |
| 4,333,986 | A | 6/1982 | Tsuji et al. |
| 4,337,980 | A | 7/1982 | Krekeler |
| 4,390,992 | A | 6/1983 | Judd |
| 4,397,361 | A | 8/1983 | Langford, Jr. |
| 4,412,980 | A | 11/1983 | Tsuji et al. |
| 4,416,339 | A | 11/1983 | Baker et al. |
| 4,425,315 | A | 1/1984 | Tsuji et al. |
| 4,439,250 | A | 3/1984 | Acharya et al. |
| 4,445,580 | A | 5/1984 | Sahley |
| 4,448,269 | A | 5/1984 | Ishikawa et al. |
| 4,465,221 | A | 8/1984 | Schmidt |
| 4,481,016 | A | 11/1984 | Campbell et al. |
| 4,484,644 | A | 11/1984 | Cook et al. |
| 4,484,783 | A | 11/1984 | Emmerich |
| 4,489,986 | A | 12/1984 | Dziak |
| 4,499,795 | A | 2/1985 | Radtke |
| 4,525,178 | A | 6/1985 | Hall |
| 4,531,592 | A | 7/1985 | Hayatdavoudi |
| 4,535,853 | A | 8/1985 | Ippolito et al. |
| 4,538,691 | A | 9/1985 | Dennis |
| 4,566,545 | A | 1/1986 | Story et al. |
| 4,574,895 | A | 3/1986 | Dolezal et al. |
| 4,599,731 | A | 7/1986 | Ware et al. |
| 4,604,106 | A | 8/1986 | Hall |
| 4,627,503 | A | 12/1986 | Horton |
| 4,636,253 | A | 1/1987 | Nakai et al. |
| 4,640,374 | A | 2/1987 | Dennis |
| 4,647,111 | A | 3/1987 | Bronder et al. |
| 4,647,546 | A | 3/1987 | Hall, Jr. et al. |
| 4,650,776 | A | 3/1987 | Cerceau et al. |
| 4,662,348 | A | 5/1987 | Hall et al. |
| 4,664,705 | A | 5/1987 | Horton et al. |
| 4,678,237 | A | 7/1987 | Collin |
| 4,682,987 | A | 7/1987 | Brady et al. |

4,684,176 A 8/1987 Den Besten et al.
4,688,856 A 8/1987 Elfgen
4,690,691 A 9/1987 Komanduri
4,694,918 A 9/1987 Hall
4,725,098 A 2/1988 Beach
4,726,718 A 2/1988 Meskin et al.
4,729,440 A 3/1988 Hall
4,729,603 A 3/1988 Elfgen
4,765,686 A 8/1988 Adams
4,765,687 A 8/1988 Parrott
4,776,862 A 10/1988 Wiand
4,852,672 A 8/1989 Behrens
4,880,154 A 11/1989 Tank
4,889,017 A 12/1989 Fuller et al.
D305,871 S 2/1990 Geiger
4,932,723 A 6/1990 Mills
4,940,099 A 7/1990 Deane et al.
4,940,288 A 7/1990 Stiffler et al.
4,944,559 A 7/1990 Sionnet et al.
4,944,772 A 7/1990 Cho
4,951,762 A 8/1990 Lundell
4,956,238 A 9/1990 Griffin
4,962,822 A 10/1990 Pascale
4,981,184 A 1/1991 Knowlton et al.
5,007,685 A 4/1991 Beach et al.
5,009,273 A 4/1991 Grabinski
5,011,515 A 4/1991 Frushour
5,027,914 A 7/1991 Wilson
5,038,873 A 8/1991 Jurgens
D324,056 S 2/1992 Frazee
D324,226 S 2/1992 Frazee
5,088,797 A 2/1992 O'Neill
5,112,165 A 5/1992 Hedlund et al.
5,119,714 A * 6/1992 Scott et al. ..... 76/108.2
5,119,892 A 6/1992 Clegg et al.
5,141,063 A 8/1992 Quesenbury
5,141,289 A 8/1992 Stiffler
D329,809 S 9/1992 Bloomfield
5,154,245 A 10/1992 Waldenstrom
5,186,268 A 2/1993 Clegg
5,186,892 A 2/1993 Pope
5,222,566 A 6/1993 Taylor et al.
5,248,006 A 9/1993 Scott et al.
5,251,964 A 10/1993 Ojanen
5,255,749 A 10/1993 Bumpurs et al.
5,261,499 A 11/1993 Grubb
5,265,682 A 11/1993 Russell et al.
D342,268 S 12/1993 Meyer
5,303,984 A 4/1994 Ojanen
5,304,342 A 4/1994 Hall, Jr. et al.
5,332,348 A 7/1994 Lemelson
5,351,770 A 10/1994 Cawthorne et al.
5,361,859 A 11/1994 Tibbitts
5,374,319 A 12/1994 Stueber et al.
D357,485 S 4/1995 Mattsson et al.
5,410,303 A 4/1995 Comeau et al.
5,417,292 A 5/1995 Polakoff
5,417,475 A 5/1995 Graham et al.
5,423,389 A 6/1995 Warren et al.
5,447,208 A 9/1995 Lund
5,494,477 A 2/1996 Flood et al.
5,507,357 A 4/1996 Hult et al.
D371,374 S 7/1996 Fischer et al.
5,533,582 A 7/1996 Tibbitts
5,535,839 A 7/1996 Brady
5,542,993 A 8/1996 Rabinkin
5,544,713 A 8/1996 Dennis
5,560,440 A 10/1996 Tibbitts
5,568,838 A 10/1996 Struthers et al.
5,653,300 A 8/1997 Lund
5,655,614 A 8/1997 Azar
5,662,720 A 9/1997 O'Tigheamaigh
5,678,644 A 10/1997 Fielder
5,709,279 A 1/1998 Dennis
5,720,528 A 2/1998 Ritchey
5,732,784 A 3/1998 Nelson
5,738,698 A 4/1998 Kapoor et al.
5,794,728 A 8/1998 Palmberg
5,811,944 A 9/1998 Sampayan et al.
5,823,632 A 10/1998 Burkett
5,837,071 A 11/1998 Andersson et al.
5,845,547 A 12/1998 Sollami
5,848,657 A 12/1998 Flood et al.
5,871,060 A 2/1999 Jensen et al.
5,875,862 A 3/1999 Jurewicz
5,884,979 A 3/1999 Latham
5,890,552 A 4/1999 Scott et al.
5,896,938 A 4/1999 Moeny et al.
5,914,055 A 6/1999 Roberts et al.
5,934,542 A 8/1999 Nakamura et al.
5,935,718 A 8/1999 Demo et al.
5,944,129 A 8/1999 Jensen
5,947,215 A 9/1999 Lundell
5,950,743 A 9/1999 Cox
5,957,223 A 9/1999 Doster et al.
5,957,225 A 9/1999 Sinor
5,967,247 A 10/1999 Pessier
5,967,250 A 10/1999 Lund
5,979,571 A 11/1999 Scott et al.
5,992,405 A 11/1999 Sollami
5,992,547 A 11/1999 Caraway et al.
5,992,548 A 11/1999 Silva et al.
6,000,483 A 12/1999 Jurewicz et al.
6,003,623 A 12/1999 Miess
6,006,846 A 12/1999 Tibbitts et al.
6,018,729 A 1/2000 Zacharia et al.
6,019,434 A 2/2000 Emmerich
6,021,859 A 2/2000 Tibbitts et al.
6,039,131 A 3/2000 Beaton
6,041,875 A 3/2000 Rai et al.
6,044,920 A 4/2000 Massa et al.
6,051,079 A 4/2000 Andersson et al.
6,056,911 A 5/2000 Griffin
6,065,552 A 5/2000 Scott et al.
6,068,913 A 5/2000 Cho et al.
6,098,730 A 8/2000 Scott et al.
6,113,195 A 9/2000 Mercier et al.
6,131,675 A 10/2000 Anderson
6,150,822 A 11/2000 Hong et al.
6,170,917 B1 1/2001 Heinrich et al.
6,186,251 B1 2/2001 Butcher
6,193,770 B1 2/2001 Sung
6,196,340 B1 3/2001 Jensen et al.
6,196,636 B1 3/2001 Mills et al.
6,196,910 B1 3/2001 Johnson et al.
6,199,645 B1 3/2001 Anderson et al.
6,199,956 B1 3/2001 Kammerer
6,202,761 B1 3/2001 Forney
6,213,226 B1 4/2001 Eppink et al.
6,216,805 B1 4/2001 Lays et al.
6,220,375 B1 4/2001 Butcher et al.
6,220,376 B1 4/2001 Lundell
6,223,824 B1 5/2001 Moyes
6,223,974 B1 5/2001 Unde
6,257,673 B1 7/2001 Markham et al.
6,258,139 B1 7/2001 Jensen
6,260,639 B1 7/2001 Yong et al.
6,269,893 B1 8/2001 Beaton et al.
6,270,165 B1 8/2001 Peay
6,272,748 B1 8/2001 Smyth
6,290,008 B1 9/2001 Portwood et al.
6,296,069 B1 10/2001 Lamine et al.
6,302,224 B1 10/2001 Sherwood, Jr.
6,302,225 B1 10/2001 Yoshida et al.
6,315,065 B1 11/2001 Aoki
6,332,503 B1 12/2001 Pessier et al.
6,340,064 B2 1/2002 Fielder et al.
6,341,823 B1 1/2002 Sollami
6,354,771 B1 3/2002 Bauschulte et al.
6,364,034 B1 4/2002 Schoeffler
6,364,420 B1 4/2002 Sollami
6,371,567 B1 4/2002 Sollami
6,375,272 B1 4/2002 Ojanen
6,375,706 B2 4/2002 Kembaiyan et al.
6,394,200 B1 5/2002 Watson et al.
6,408,052 B1 6/2002 McGeoch
6,408,959 B2 6/2002 Bertagnolli et al.
6,419,278 B1 7/2002 Cunningham

| | | | |
|---|---|---|---|
| 6,429,398 | B1 | 8/2002 | Legoupil et al. |
| 6,439,326 | B1 | 8/2002 | Huang et al. |
| 6,460,637 | B1 | 10/2002 | Siracki et al. |
| 6,468,368 | B1 | 10/2002 | Merrick et al. |
| 6,474,425 | B1 | 11/2002 | Truax et al. |
| 6,478,383 | B1 | 11/2002 | Ojanen et al. |
| 6,481,803 | B2 | 11/2002 | Ritchey |
| 6,484,825 | B2 | 11/2002 | Watson et al. |
| 6,484,826 | B1 | 11/2002 | Anderson et al. |
| 6,499,547 | B2 | 12/2002 | Scott et al. |
| 6,508,318 | B1 | 1/2003 | Linden et al. |
| 6,510,906 | B1 | 1/2003 | Richert et al. |
| 6,513,606 | B1 | 2/2003 | Krueger |
| 6,517,902 | B2 | 2/2003 | Drake et al. |
| 6,533,050 | B2 | 3/2003 | Molloy |
| 6,561,293 | B2 | 5/2003 | Minikus et al. |
| 6,562,462 | B2 | 5/2003 | Griffin et al. |
| D477,225 | S | 7/2003 | Pinnavaia |
| 6,585,326 | B2 | 7/2003 | Sollami |
| 6,592,985 | B2 | 7/2003 | Griffin et al. |
| 6,594,881 | B2 | 7/2003 | Tibbitts |
| 6,596,225 | B1 | 7/2003 | Pope et al. |
| 6,601,454 | B1 | 8/2003 | Botnan |
| 6,601,662 | B2 * | 8/2003 | Matthias et al. ..... 175/374 |
| 6,622,803 | B2 | 9/2003 | Harvey et al. |
| 6,668,949 | B1 | 12/2003 | Rives |
| 6,672,406 | B2 | 1/2004 | Beuershausen |
| 6,685,273 | B1 | 2/2004 | Sollami |
| 6,692,083 | B2 | 2/2004 | Latham |
| 6,702,393 | B2 | 3/2004 | Mercier |
| 6,709,065 | B2 | 3/2004 | Peay et al. |
| 6,711,060 | B2 | 3/2004 | Sakakibara |
| 6,719,074 | B2 | 4/2004 | Tsuda et al. |
| 6,729,420 | B2 | 5/2004 | Mensa-Wilmot |
| 6,732,817 | B2 | 5/2004 | Dewey et al. |
| 6,732,914 | B2 | 5/2004 | Cadden et al. |
| 6,733,087 | B2 | 5/2004 | Hall et al. |
| 6,739,327 | B2 | 5/2004 | Sollami |
| 6,749,033 | B2 | 6/2004 | Griffin et al. |
| 6,758,530 | B2 | 7/2004 | Sollami |
| D494,031 | S | 8/2004 | Moore, Jr. |
| D494,064 | S | 8/2004 | Hook |
| 6,786,557 | B2 | 9/2004 | Montgomery, Jr. |
| 6,802,676 | B2 | 10/2004 | Noggle |
| 6,822,579 | B2 | 11/2004 | Goswami et al. |
| 6,824,225 | B2 | 11/2004 | Stiffler |
| 6,846,045 | B2 | 1/2005 | Sollami |
| 6,851,758 | B2 | 2/2005 | Beach |
| 6,854,810 | B2 | 2/2005 | Montgomery, Jr. |
| 6,861,137 | B2 | 3/2005 | Griffin et al. |
| 6,878,447 | B2 | 4/2005 | Griffin |
| 6,880,744 | B2 | 4/2005 | Noro et al. |
| 6,889,890 | B2 | 5/2005 | Yamazaki et al. |
| 6,929,076 | B2 | 8/2005 | Fanuel et al. |
| 6,933,049 | B2 | 8/2005 | Wan et al. |
| 6,953,096 | B2 | 10/2005 | Gledhill et al. |
| 6,959,765 | B2 | 11/2005 | Bell |
| 6,962,395 | B2 | 11/2005 | Mouthaan |
| 6,966,611 | B1 | 11/2005 | Sollami |
| 6,994,404 | B1 | 2/2006 | Sollami |
| 7,048,081 | B2 | 5/2006 | Smith et al. |
| 7,204,560 | B2 | 4/2007 | Mercier et al. |
| D547,652 | S | 7/2007 | Kerman et al. |
| D560,699 | S | 1/2008 | Omi |
| 7,350,601 | B2 | 4/2008 | Belnap et al. |
| 7,377,341 | B2 | 5/2008 | Middlemiss et al. |
| 7,380,888 | B2 | 6/2008 | Ojanen |
| 7,396,086 | B1 | 7/2008 | Hall et al. |
| 7,543,662 | B2 | 6/2009 | Belnap et al. |
| 7,575,425 | B2 | 8/2009 | Hall et al. |
| 7,592,077 | B2 | 9/2009 | Gates, Jr. et al. |
| 7,665,552 | B2 | 2/2010 | Hall |
| 7,703,559 | B2 | 4/2010 | Shen et al. |
| 7,730,977 | B2 | 6/2010 | Achilles |
| 7,798,258 | B2 | 9/2010 | Singh et al. |
| 2001/0004946 | A1 | 6/2001 | Jensen |
| 2002/0074851 | A1 | 6/2002 | Montgomery, Jr. |
| 2002/0153175 | A1 | 10/2002 | Ojanen |
| 2002/0175555 | A1 | 11/2002 | Mercier |
| 2003/0079565 | A1 | 5/2003 | Liang et al. |
| 2003/0141350 | A1 | 7/2003 | Noro et al. |
| 2003/0209366 | A1 | 11/2003 | McAlvain |
| 2003/0213621 | A1 | 11/2003 | Britten |
| 2003/0217869 | A1 | 11/2003 | Snyder et al. |
| 2003/0234280 | A1 | 12/2003 | Cadden et al. |
| 2004/0026132 | A1 | 2/2004 | Hall |
| 2004/0026983 | A1 | 2/2004 | McAlvain |
| 2004/0065484 | A1 | 4/2004 | McAlvain |
| 2004/0155096 | A1 | 8/2004 | Zimmerman et al. |
| 2004/0238221 | A1 | 12/2004 | Runia et al. |
| 2004/0256155 | A1 | 12/2004 | Kriesels |
| 2004/0256442 | A1 | 12/2004 | Gates, Jr. |
| 2005/0044800 | A1 | 3/2005 | Hall et al. |
| 2005/0159840 | A1 | 7/2005 | Lin et al. |
| 2005/0173966 | A1 | 8/2005 | Mouthaan |
| 2005/0263327 | A1 | 12/2005 | Meiners et al. |
| 2006/0060391 | A1 | 3/2006 | Eyre et al. |
| 2006/0086537 | A1 | 4/2006 | Dennis |
| 2006/0086540 | A1 | 4/2006 | Griffin |
| 2006/0162969 | A1 | 7/2006 | Belnap et al. |
| 2006/0180354 | A1 | 8/2006 | Belnap et al. |
| 2006/0186724 | A1 | 8/2006 | Stehney |
| 2006/0237236 | A1 | 10/2006 | Sreshta et al. |
| 2007/0193782 | A1 | 8/2007 | Fang |
| 2007/0278017 | A1 | 12/2007 | Shen et al. |
| 2008/0006448 | A1 | 1/2008 | Zhang et al. |
| 2008/0053710 | A1 | 3/2008 | Moss |
| 2008/0073126 | A1 | 3/2008 | Shen et al. |
| 2008/0073127 | A1 | 3/2008 | Zhan et al. |
| 2008/0142276 | A1 | 6/2008 | Griffo et al. |
| 2008/0156544 | A1 | 7/2008 | Singh et al. |
| 2008/0206576 | A1 | 8/2008 | Qian et al. |

FOREIGN PATENT DOCUMENTS

| | | |
|---|---|---|
| DE | 3 818 213 | 11/1989 |
| DE | 4 039 217 | 6/1992 |
| DE | 19 821 147 | 11/1999 |
| DE | 10 163 717 | 5/2003 |
| EP | 0 295 151 | 6/1988 |
| EP | 0 412 287 | 2/1991 |
| GB | 2 004 315 | 3/1979 |
| GB | 2 037 223 | 7/1980 |
| JP | 5 280 273 | 10/1993 |

OTHER PUBLICATIONS

International Preliminary Report on Patentability Chapter II for PCT/US07/75670, completed Aug. 24, 2009 (4 pages).

International Report on Patentability Chapter I for PCT/US07/75670, mailed Nov. 17, 2008 (6 pages).

* cited by examiner

DEGRADATION ASSEMBLY

This application is a continuation of U.S. patent application Ser. No. 12/051,738 filed on Mar. 19, 2008 and which is now U.S. Pat. No. 7,669,674 issued on Mar. 2, 2010, which is a continuation of U.S. patent application Ser. No. 12/051,689 filed on Mar. 19, 2008 and which is now U.S. Pat. No. 7,963,617 issued on Jun. 21, 2011, which is a continuation-in-part of U.S. patent application Ser. No. 12/051,586 filed on Mar. 19, 2008 and which is now U.S. Pat. No. 8,007,050 issued on Aug. 30, 2011, which is a continuation of U.S. patent application Ser. No. 12/021,051 filed on Jan. 28, 2008, which is a continuation of U.S. patent application Ser. No. 12/021,019 filed on Jan. 28, 2008, which is a continuation-in-part of U.S. patent application Ser. No. 11/971,965 filed on Jan. 10, 2008 and which is now U.S. Pat. No. 7,648,210 issued on Jan. 19, 2010, which is a continuation of U.S. patent application Ser. No. 11/947,644 filed on Nov. 29, 2007 and which is now U.S. Pat. No. 8,007,051 issued on Aug. 30, 2011, which is a continuation-in-part of U.S. patent application Ser. No. 11/844,586 filed on Aug. 24, 2007 and which is now U.S. Pat. No. 7,600,823 issued on Oct. 13, 2009. U.S. patent application Ser. No. 11/844,586 is a continuation-in-part of U.S. patent application Ser. No. 11/829,761 filed on Jul. 27, 2007 and which is now U.S. Pat. No. 7,722,127 issued on May 25, 2010. U.S. patent application Ser. No. 11/829,761 is a continuation-in-part of U.S. patent application Ser. No. 11/773,271 filed on Jul. 3, 2007 and which is now U.S. Pat. No. 7,997,661 issued on Aug. 16, 2011. U.S. patent application Ser. No. 11/773,271 is a continuation-in-part of U.S. patent application Ser. No. 11/766,903 filed on Jun. 22, 2007. U.S. patent application Ser. No. 11/766,903 is a continuation of U.S. patent application Ser. No. 11/766,865 filed on Jun. 22, 2007. U.S. patent application Ser. No. 11/766,865 is a continuation-in-part of U.S. patent application Ser. No. 11/742,304 filed on Apr. 30, 2007 and which is now U.S. Pat. No. 7,475,948 issued on Jan. 13, 2009. U.S. patent application Ser. No. 11/742,304 is a continuation of U.S. patent application Ser. No. 11/742,261 filed on Apr. 30, 2007 and which is now U.S. Pat. No. 7,469,971 issued on Dec. 30, 2008. U.S. patent application Ser. No. 11/742,261 is a continuation-in-part of U.S. patent application Ser. No. 11/464,008 filed on Aug. 11, 2006 and which is now U.S. Pat. No. 7,338,135 issued on Mar. 4, 2008. U.S. patent application Ser. No. 11/464,008 is a continuation-in-part of U.S. patent application Ser. No. 11/463,998 filed on Aug. 11, 2006 and which is now U.S. Pat. No. 7,384,105 issued on Jun. 10, 2008. U.S. patent application Ser. No. 11/463,998 is a continuation-in-part of U.S. patent application Ser. No. 11/463,990 filed on Aug. 11, 2006 and which is now U.S. Pat. No. 7,320,505 issued on Jan. 22, 2008. U.S. patent application Ser. No. 11/463,990 is a continuation-in-part of U.S. patent application Ser. No. 11/463,975 filed on Aug. 11, 2006 and which is now U.S. Pat. No. 7,445,294 issued on Nov. 4, 2008. U.S. patent application Ser. No. 11/463,975 is a continuation-in-part of U.S. patent application Ser. No. 11/463,962 filed on Aug. 11, 2006 and which is now U.S. Pat. No. 7,413,256 issued on Aug. 19, 2008. The present application is also a continuation-in-part of U.S. patent application Ser. No. 11/695,672 filed on Apr. 3, 2007 and which is now U.S. Pat. No. 7,396,086 issued on Jul. 8, 2008. U.S. patent application Ser. No. 11/695,672 is a continuation-in-part of U.S. patent application Ser. No. 11/686,831 filed on Mar. 15, 2007 and which is now U.S. Pat. No. 7,568,770 issued on Aug. 4, 2009. All of these applications are herein incorporated by reference for all that they contain.

BACKGROUND

This invention relates to drill bits, specifically drill bit assemblies for use in oil, gas and geothermal drilling. More particularly, the invention relates to cutting elements in drill bits comprised of a carbide substrate with an abrasion resistant layer of superhard material.

Such cutting elements are often subjected to intense forces, torques, vibration, high temperatures, and temperature differentials during operation. As a result, stresses within the structure begin to form. Drag bits, for example, may exhibit stresses aggravated by drilling anomalies during well boring operations such as bit whirl or bounce often resulting in spalling, delamination, or fracture of the superhard abrasive layer or the substrate thereby reducing or eliminating the cutting elements efficacy and decreasing overall drill bit wear life. The superhard material layer of a cutting element may delaminate from the carbide substrate after the sintering process in addition to during percussive and abrasive use. Damage typically found in drag bits may be a result of shear failures, although non-shear modes of failure are not uncommon. The interface between the super hard material layer and substrate is particularly susceptible to non-shear failure modes due to inherent residual stresses.

U.S. Pat. No. 6,332,503 to Pessier et al., which is herein incorporated by reference for all that it contains, discloses an array of chisel-shaped cutting elements mounted to the face of a fixed cutter bit. Each cutting element has a crest and an axis which is inclined relative to the borehole bottom. The chisel-shaped cutting elements may be arranged on a selected portion of the bit, such as the center of the bit, or across the entire cutting surface. In addition, the crest on the cutting elements may be oriented generally parallel or perpendicular to the borehole bottom.

U.S. Pat. No. 6,408,959 to Bertagnolli et al., which is herein incorporated by reference for all that it contains, discloses a cutting element, insert or compact which is provided for use with drills used in the drilling and boring of subterranean formations.

U.S. Pat. No. 6,484,826 to Anderson et al., which is herein incorporated by reference for all that it contains, discloses enhanced inserts formed having a cylindrical grip and a protrusion extending from the grip.

U.S. Pat. No. 5,848,657 byto Flood et al., which is herein incorporated by reference for all that it contains, discloses a domed polycrystalline diamond cutting element wherein a hemispherical diamond layer is bonded to a tungsten carbide substrate, commonly referred to as a tungsten carbide stud. Broadly, the inventive cutting element includes a metal carbide stud having a proximal end adapted to be placed into a drill bit and a distal end portion. A layer of cutting polycrystalline abrasive material disposed over said distal end portion such that an annulus of metal carbide adjacent and above said drill bit is not covered by said abrasive material layer.

U.S. Pat. No. 4,109,737 to Bovenkerk, which is herein incorporated by reference for all that it contains, discloses a rotary bit for rock drilling comprising a plurality of cutting elements mounted by interference-fit in recesses in the crown of the drill bit. Each cutting element comprises an elongated pin with a thin layer of polycrystalline diamond bonded to the free end of the pin.

U.S. Patent Application Serial No. 2001/0004946 by Jensen, although now abandoned, is herein incorporated by reference for all that it discloses. Jensen teaches a cutting element or insert with improved wear characteristics while maximizing the manufacturability and cost effectiveness of the insert. This insert employs a superabrasive diamond layer of increased depth by making use of a diamond layer surface that is generally convex.

BRIEF SUMMARY

In one aspect of the invention, a degradation assembly has a working portion with at least one impact tip brazed to a carbide extension. The carbide extension has a cavity formed in a base end and is adapted to interlock with a shank assembly of the cutting element assembly. The shank assembly has a locking mechanism adapted to interlock a first end of the shank assembly within the cavity. The locking mechanism has a radially extending catch formed in the first end of the shank assembly. The shank assembly has an outer surface at a second end of the shank assembly adapted to be press-fitted within a recess of a driving mechanism. The outer surface of the shank assembly has a coefficient of thermal expansion of 110 percent or more than a coefficient of thermal expansion of a material of the driving mechanism.

The cavity may have an inwardly protruding catch. The inwardly protruding catch may be adapted to interlock with the radially extending catch. An insert may be intermediate the inwardly protruding catch and the radially extending catch. The insert may be a ring, a snap ring, a split ring, or a flexible ring. The insert may also be a plurality of balls, wedges, shims or combinations thereof. The insert may be a spring.

The locking mechanism may have a locking shaft extending from the first end of the shank assembly towards the second end of the shank assembly. The locking mechanism of the shank assembly may be mechanically connected to the outer surface of the shank assembly. Mechanically connecting the locking mechanism to the outer surface may apply tension along a length of the locking shaft. The locking mechanism may have a coefficient of thermal expansion equal to or less than the coefficient of thermal expansion of the outer surface. The shank assembly may be formed of steel.

The tip may comprise a superhard material bonded to a cemented metal carbide substrate at a non-planar interface. The cemented metal carbide substrate may be brazed to the carbide extension. The cemented metal carbide substrate may have the same coefficient of thermal expansion as the carbide extension. The cemented metal carbide substrate may have a thickness of 0.30 to 0.65 times a thickness of the superhard material. At least two impact tips may be brazed to the carbide extension.

The assembly may be incorporated in drill bits, shear bits, percussion bits, roller cone bits or combinations thereof. The assembly may be incorporated in mining picks, trenching picks, asphalt picks, excavating picks or combinations thereof. The carbide extension may comprise a drill bit blade, a drill bit working surface, a pick bolster, or combinations thereof.

DETAILED DESCRIPTION

Figure 1:
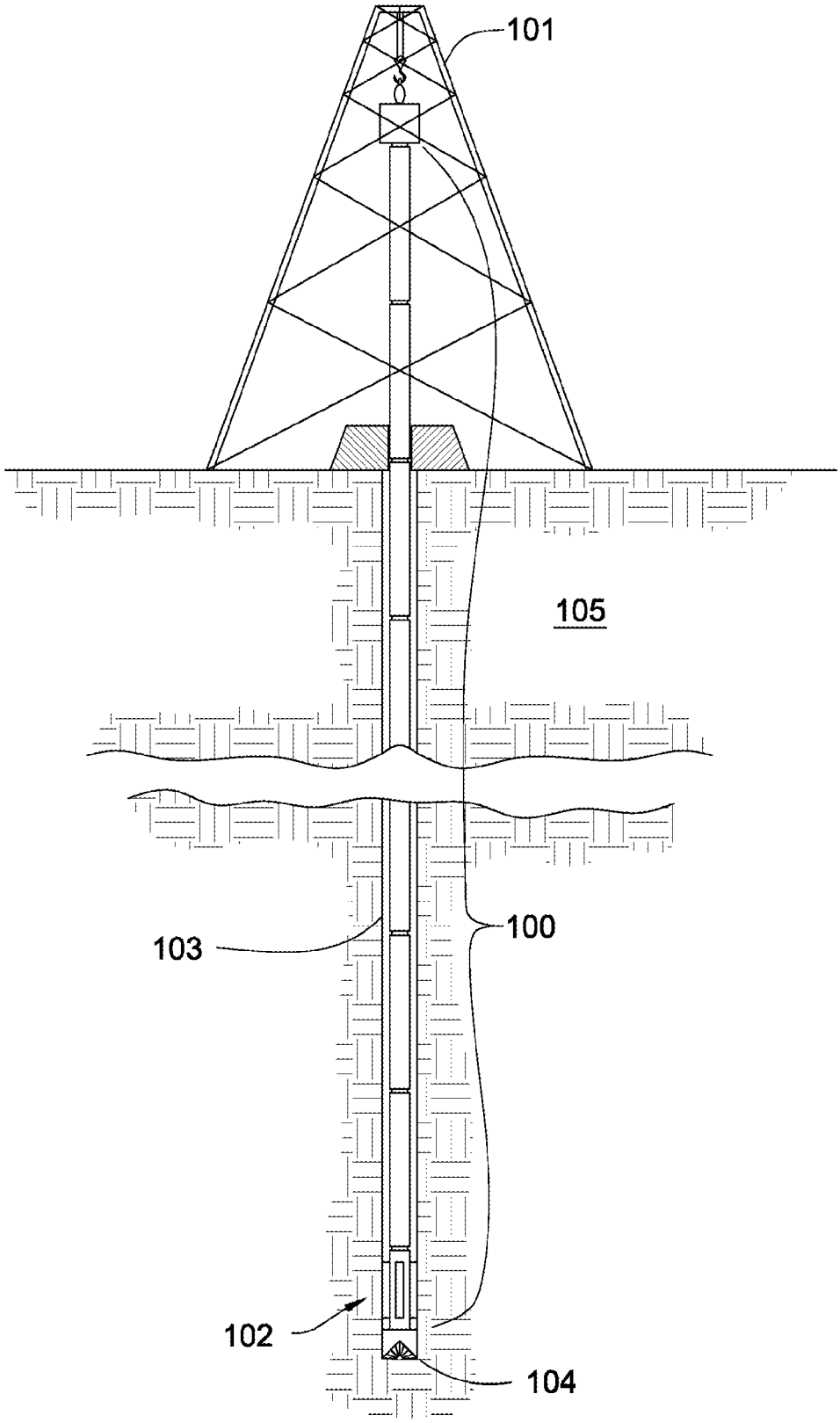
FIG. 1 is a orthogonal diagram of an embodiment of a drill string suspended in a cross section of a bore hole.

Referring now to the figures, FIG. 1 is a cross-sectional diagram of an embodiment of a drill string 100 suspended by a derrick 101. A bottom-hole assembly 102 is located at the bottom of a bore hole 103 and comprises a bit 104 and a stabilizer assembly. As the drill bit 104 rotates down hole the drill string 100 advances farther into the earth. The drill string 100 may penetrate soft or hard subterranean formations 105.

Figure 2:
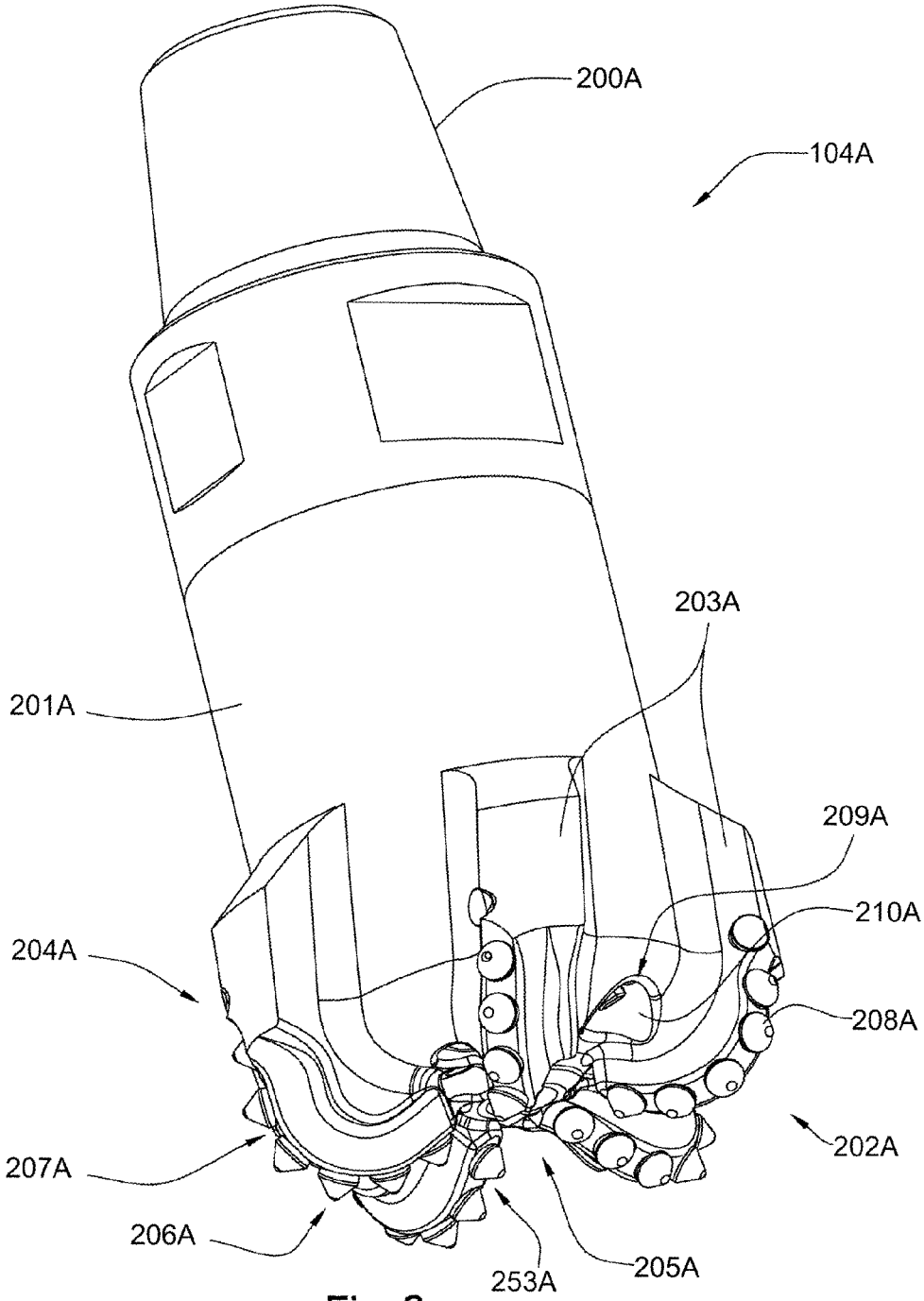
FIG. 2 is a perspective diagram of an embodiment of a rotary drag bit.

FIG. 2 illustrates an embodiment wherein a drill bit 104A may be a rotary drag bit. The drill bit 104A includes a shank 200A which is adapted for connection to a drill string, such as drill string 100 of FIG. 1. In some embodiments, coiled tubing or other types of tool string may be used. The drill bit 104A of the present embodiment is intended for deep oil and gas drilling, although any type of drilling application is anticipated, such as horizontal drilling, geothermal drilling, mining, exploration, on and off-shore drilling, directional drilling, water well drilling, and any combination thereof.

A bit body 201A is attached to the shank 200A and has an end which forms a working face 202A. Several blades 203A extend outwardly from the bit body 201A, each of which may have a plurality of cutting inserts 208A. A drill bit 104A most suitable for the present invention may have at least three blades 203A; preferably the drill bit 104A will have between three and seven blades 203A. The blades 203A collectively form an inverted conical region 205A. Each blade 203A may have a cone portion 253, a nose portion 206A, a flank portion 207A, and a gauge portion 204A. Cutting inserts 208A may be arrayed along any portion of the blades 203A, including the cone portion 253A, nose portion 206A, flank portion 207A, and gauge portion 204A. 207A, and gauge portion 204A.

A plurality of nozzles 209A are fitted into recesses 210A formed in the working face 202A. Each nozzle 209A may be oriented such that a jet of drilling mud ejected from the nozzles 209A engages the formation before or after the cutting elements 208A. The jets of drilling mud may also be used to clean cuttings away from drill bit 104A. In some embodiments, the jets may be used to create a sucking effect to remove drill bit cuttings adjacent the cutting inserts 208A by creating a low pressure region within their vicinities.

Figure 3:
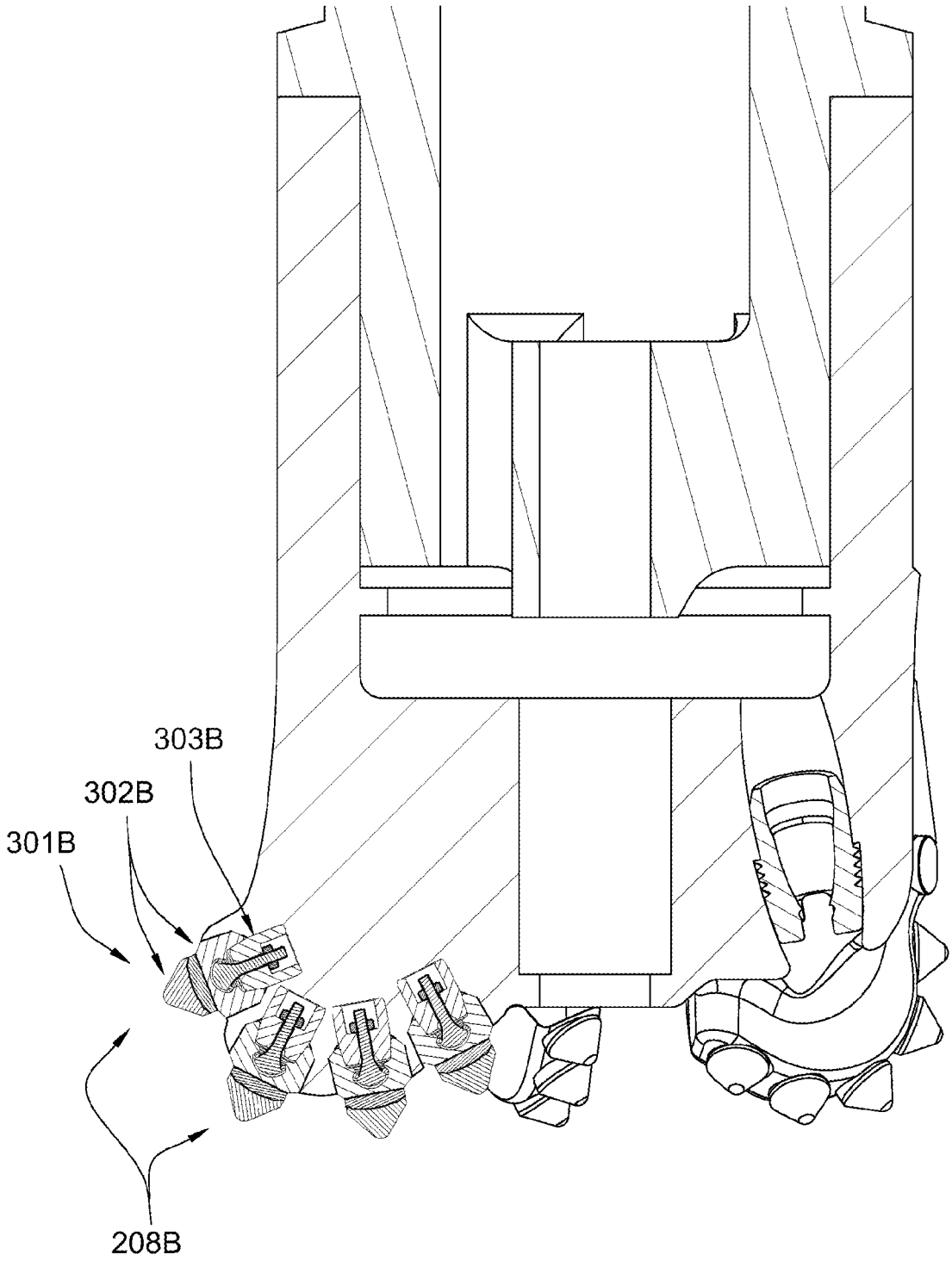
FIG. 3 is a cross-sectional diagram of another embodiment of a rotary drag bit.

*Fig.* 3 illustrates a cross section of a drill bit showing a cross section of a cutting insert 208B. The cutting insert 208B of FIG. 3 is a degradation assembly 301B. The degradation assembly 301B comprises a working portion 302B and a shank assembly 303B.

Figure 4:
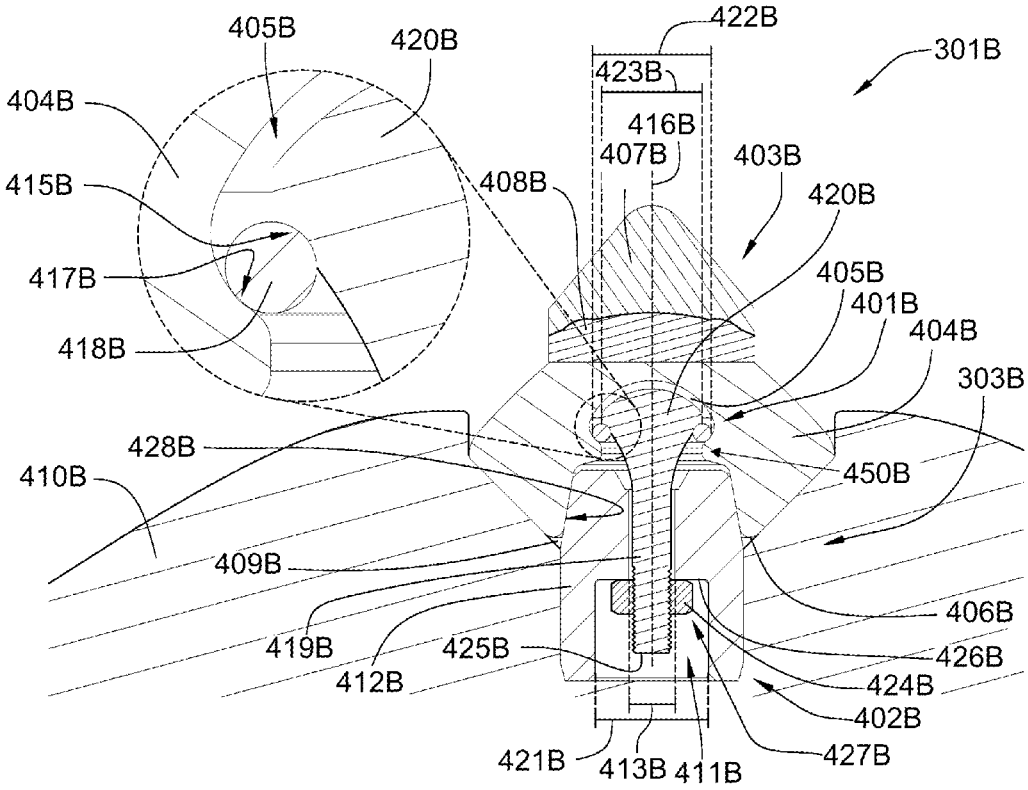
FIG. 4 is a cross-sectional diagram of an embodiment of a degradation assembly.

FIG. 4 is close up cross sectional view of the degradation assembly 301B of FIG. 3. The shank assembly 303B has a first end 401B and a second end 402B. The working portion 302B includes an impact tip 403B that is brazed to a cemented metal carbide extension 404B. The cemented metal carbide extension 404B is adapted to interlock with the shank assembly 303B. The first end 401B of the shank assembly 303B is be adapted to fit into a cavity 405B formed in a base end 406B of the cemented metal carbide extension 404B. A superhard material 407B is bonded to a cemented metal carbide substrate 408B to form the impact tip 403B, which is bonded to the carbide extension 404B opposite the base end 406B of the cemented metal carbide extension 404B and opposite the first end 401B of the shank assembly 303B. In FIG. 4 the shank assembly 303B is generally cylindrical. The second end 402B of the shank assembly 303B is press-fitted into a recess 409B of a driving mechanism 410B. The drill bit blade 203A or bit body 201A of FIG. 2 may be the driving mechanism 410B.

The shank assembly 303B may be formed of a hard material such as steel, stainless steel, hardened steel, or other materials of similar hardness. The carbide extension 404B may be formed of a material such as tungsten, titanium, tantalum, molybdenum, niobium, cobalt and/or combinations thereof.

The shank assembly 303B may be work-hardened or cold-worked in order to provide resistance to cracking or stress fractures due to forces exerted on the degradation assembly 301B by a formation. The shank assembly 303B may be work-hardened by shot-peening or by other methods of work-hardening. At least a portion of the shank assembly 303B may also be work-hardened by stretching it during a manufacturing process.

The shank assembly 303B includes a locking mechanism 411B has outer surface 412B. The locking mechanism 411B is axially disposed within a bore 413B of the second end 402 of the shank assembly 303B and the locking mechanism 411B is secured within or below the bore 413B. The first end 401B of the shank assembly 303B protrudes into the cavity 405B in the base end 406B of the cemented metal carbide extension 404B and the outer surface 412B of the first end 401B may be adapted to fit into the cavity 405B in the base end 406B of the cemented metal carbide extension 404B. The locking mechanism 411B is adapted to lock the first end 401B of the shank assembly 303B within the cavity 405B. The locking mechanism 411B may attach the shank assembly 303B to the cemented metal carbide extension 404B and restrict movement of the shank assembly 303B with respect to the cemented metal carbide extension 404B. The locking mechanism 411B has a radially extending catch 415B that is formed in the first end 401B of the shank assembly 303B. The shank assembly 303B may be prevented by the locking mechanism 411B from moving in a direction parallel to a central axis 416B of the degradation assembly 301B. In some embodiments the shank assembly 303B may be prevented by the locking mechanism 411B from rotating about the central axis 416B.

In FIG. 4 the cavity 405B has an inwardly protruding catch 417B. An insert 418B is disposed between the inwardly protruding catch 417B of the cavity 405B and the radially extending catch 415B of the locking mechanism 411B. In some embodiments the insert 418B is a flexible ring. In some embodiments the insert 418B may be a ring, a snap ring, a split ring, coiled ring, a flexible ring, or combinations thereof. In FIG. 4 the locking mechanism 411B is a locking shaft 419B. The locking shaft 419B is connected to an expanded locking head 420B. In some embodiments the radially extending catch 415B is an undercut formed in the locking head 420B. The insert 418B and locking head 420B are disposed within the cavity 405B of the cemented metal carbide extension 404B. The locking shaft 419B protrudes from the cavity 405B and into an inner diameter 421B of the shank assembly 303B. The locking shaft 419B is disposed proximate the bore 413B proximate the first end 401B of the shank assembly 303B. The locking shaft 419B is adapted for translation in a direction parallel to the central axis 416B of the shank assembly 303B. The locking shaft 419B may extend from the cavity 405B and the insert 418B may be inserted into the cavity 405B.

When a first end 450 of the locking mechanism 411 is inserted into the cavity 405B, the locking head 420B may be extended away from the bore 413 of the outer surface 412. The insert 418B may be disposed around the locking shaft 419 and be between the locking head 420B and the bore 413B. The insert 418B may be formed of stainless steel. In some embodiments the insert 418B may be formed of an elastomeric material and may be flexible. The insert 418B may be a ring, a snap ring, a split ring, a coiled ring, a rigid ring, segments, balls, wedges, shims, a spring, or combinations thereof.

The insert 418B may have a breadth 422B that is larger than a breadth 423B of an opening of the cavity 405B. In such embodiments the insert 418B may compress to have a smaller breadth 422B than the breadth 423B of the opening. Once the insert 418B is past the opening, the insert 418B may expand to its original or substantially original breadth 422B. With both the insert 418B and the locking head 420B inside the cavity 405B, the rest of the first end 401B of the shank assembly 303B may be inserted into the cavity 405B of the cemented metal carbide extension 404B. Once the entire first end 401B of the shank assembly 303B is inserted into the cavity 405B to a desired depth a nut 424B may be threaded onto an exposed end 425B of the locking shaft 419B until the nut 424B contacts a ledge 426B proximate the bore 413B mechanically connecting the locking mechanism 411B to the outer surface 412. This contact and further threading of the nut 424B on the locking shaft 419B causes the locking shaft 419B to move toward the second end 402B of the shank assembly 303B in a direction parallel to the central axis 416B of the shank assembly 303B. This may also result in bringing the radially extending catch 415B of the locking head 420B into contact with the insert 418B, and bringing the insert 418B into contact with the inwardly protruding catch 417B of the cavity 405B. The nut 424B is an example of a tensioning mechanism 427B. The tensioning mechanism 427B is adapted to apply a rearward force on the first end 401B of the shank assembly 303B. The rearward force may pull the first end 401B of the shank assembly 303B in the direction of the second end 402B and applies tension along a length of the locking shaft 419B. In some embodiments the tensioning mechanism 427B may be a press fit, a taper, and/or a nut 424B.

Once the nut 424B is threaded tightly onto the locking shaft 419B, the locking head 420B and insert 41B8 are together too wide to exit the opening 423B. In some embodiments the contact between the locking head 420B and the cemented metal carbide extension 404B via the insert 418B may be sufficient to prevent both rotation of the shank assembly 303B about its central axis 416B and movement of the shank assembly 303B in a direction parallel to its central axis 416B. In some embodiments the locking mechanism 411B is also adapted to inducibly release the shank assembly 303B from attachment with the carbide extension 404B by removing the nut 424B from the locking shaft 419B.

In some embodiments the insert 418B is be a snap ring. The insert 418B may be stainless steel and may be deformed by the pressure of the locking head 420B being pulled towards the second end 402B of the shank assembly 303B. As the insert 418B deforms it may become harder. The deformation may also cause the insert 418B to be complementary to both the inwardly protruding catch 417B and the radially extending catch 415B. This dually complementary insert 418B may avoid point loading or uneven loading, thereby equally distributing contact stresses. In such embodiments the insert 418B may be inserted when it is comparatively soft, and then may be work hardened while in place proximate the catches 236B, 237B.

In some embodiments at least part of the shank assembly 303B of the degradation assembly 301B may also be cold worked. The locking mechanism 411B may be stretched to a critical point just before the strength of the locking mechanism 411B is compromised. In some embodiments, the locking shaft 419B, locking head 420B, and insert 418B may all be cold worked by tightening the nut 424B until the locking shaft and head 419B, 420B, and the insert 418B, reach a stretching critical point. During this stretching,. the insert 418B, and the locking shaft 419 and the locking head 420B, may all deform to create a complementary engagement, and may then be hardened in that complementary engagement. In some embodiments the complementary engagement may result in an interlocking between the radially extending catch 415B and the inwardly protruding catch 417B.

In the embodiment of FIG. 4, both the inwardly protruding catch 417B and the radially extending catch 415B are tapers. Also in FIG. 4, the base end 406B of the carbide extension 404B has a uniform inward taper 428B.

Figure 5:
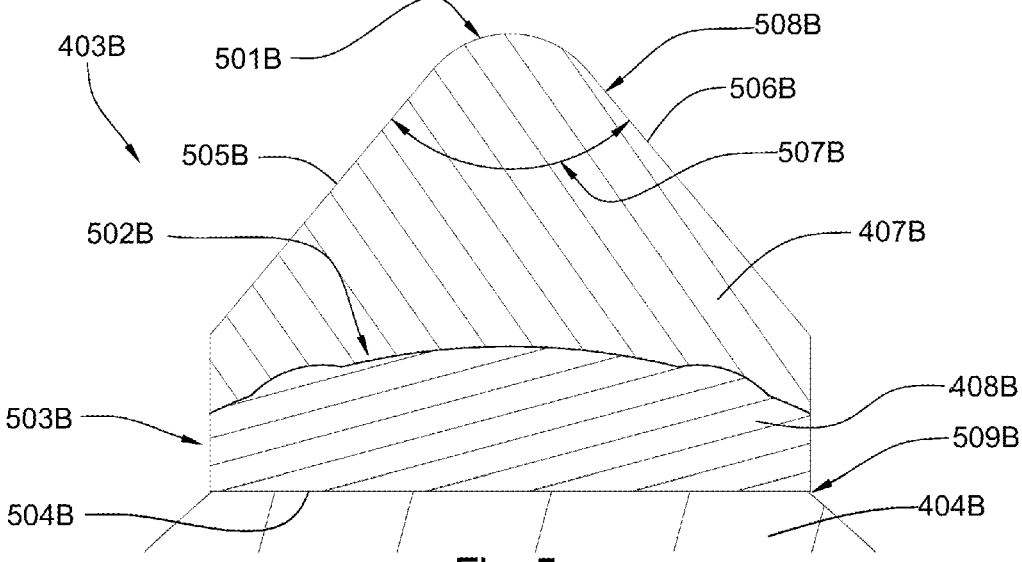
FIG. 5 is a cross-sectional diagram of an embodiment of an impact tip.

FIG. 5 is a close up view of the impact tip of FIG. 4. The impact tip 403B comprises the superhard material 407B bonded to the carbide substrate 408B. The superhard material 407B has a volume greater than a volume of the carbide substrate 408B. In some embodiments the superhard material 407B may have a volume that is 75% to 175% of a volume of the carbide substrate 408B.

The superhard material 407B has a substantially conical geometry with an apex 501B. Preferably, an interface 502B between the substrate 408B and the superhard material 407B is non-planar, which may help distribute loads on the tip 403B across a larger area of the interface 502B. At the interface 502B the substrate 408B may have a tapered surface starting from a cylindrical rim 503B of the substrate 408B and ending at an elevated flatted central region formed in the substrate 408B. The flatted central region may have a diameter of 0.20 percent to 0.60 percent of a diameter of the cylindrical rim 503B.

A thickness from the apex 501B to the non-planar interface 502B is at least 1.5 times a thickness of the substrate 408B from the non-planar interface 502B to its base 504B. In some embodiments the thickness from the apex 501B to the non-planar interface 502B may be at least 2 times a thickness of the substrate 408B from the non-planar interface to its base 504B. The substrate 408B may have a thickness of 0.30 to 0.65 times the thickness of the superhard material 407B. In some embodiments, the thickness of the substrate is less than 0.100 inches, preferably less than 0.060 inches. The thickness from the apex 501B to the non-planar interface 502B may be from 0.190 inches to 0.290 inches. Together, the superhard material 407 and the substrate 408 may have a total thickness of 0.200 inches to 0.500 inches from the apex 501B to the base of the substrate 504B.

The superhard material 407B bonded to the substrate 408B may have a substantially conical geometry with an apex 501B having a 0.065 inch to 0.095 inch radius. The substantially conical geometry comprises a first side 505B that may form a 50 degree to 80 degree included angle 507B with a second side 506B of the substantially conical geometry. In asphalt milling applications, the inventors have discovered that an optimal included angle is 45 degrees, whereas in mining applications the inventors have discovered that an optimal included angle is between 35 and 40 degrees. The tip 403B has a ratio between the an included angle 507B and the thickness from the apex 501B to the non-planar interface 502B of 240 degrees per inch to 440 degrees per inch. The tip 403B may have a ratio between the included angle 507B and a total thickness from the apex 501B to a base 504B of the substrate 408B ratio of 160 degrees per inch to 280 degrees per inch. A tip that may be compatible with the present invention is disclosed in U.S. patent Application Ser. No. 11/673,634 to Hall and is currently pending.

The superhard material 407B may be a material selected from the group consisting of diamond, polycrystalline diamond, natural diamond, synthetic diamond, vapor deposited diamond, silicon bonded diamond, cobalt bonded diamond, thermally stable diamond, polycrystalline diamond with a binder concentration of 1 to 40 weight percent, infiltrated diamond, layered diamond, monolithic diamond, polished diamond, course diamond, fine diamond, cubic boron nitride, diamond impregnated matrix, diamond impregnated carbide, and metal catalyzed diamond. The superhard material 407B may also comprise infiltrated diamond. The superhard material 407B may comprise an average diamond grain size of 1 to 100 microns. The superhard 407B material may comprise a monolayer of diamond. For the purpose of this patent the word monolayer is defined herein as a singular continuous layer of a material of indefinite thickness.

The superhard material 407B may have a metal catalyst concentration of less than 5 percent by volume. The superhard material 407B may be leached of a catalyzing material to a depth of no greater than at least 0.5 mm from a working surface 508B of the superhard material 407B. A description of leaching and its benefits is disclosed in U.S. Pat. No. 6,562,462 to Griffin et al, which is herein incorporated by reference for all that it contains. Isolated pockets of catalyzing material may exist in the leached region of the superhard material 407B. The depth of at least 0.1 mm from the working surface 508B may have a catalyzing material concentration of 5 to 1 percent by volume.

The impact tip 403B may be brazed onto the carbide extension 404B at a braze interface 509B. Braze material used to braze the tip 403B to the carbide extension 404B may have a melting temperature from 700 to 1200 degrees Celsius; preferably the melting temperature is from 800 to 970 degrees Celsius. The braze material may be composed of silver, gold, copper nickel, palladium, boron, chromium, silicon, germanium, aluminum, iron, cobalt, manganese, titanium, tin, gallium, vanadium, phosphorus, molybdenum, platinum, or combinations thereof. The braze material may comprise 30 to 62 weight percent palladium, preferable 40 to 50 weight percent palladium. Additionally, the braze material may comprise 30 to 60 weight percent nickel, and 3 to 15 weight percent silicon; preferably the braze material may comprise 47.2 weight percent nickel, 46.7 weight percent palladium, and 6.1 weight percent silicon. Active cooling during brazing may be critical in some embodiments, since the heat from brazing may leave some residual stress in the bond between the carbide substrate 408B and the superhard material 407B. The farther away the superhard material 407B is from the braze interface 509B, the less thermal damage is likely to occur during brazing. Increasing the distance between the brazing interface 509B and the superhard material 407B, however, may increase the moment on the carbide substrate 408B and increase stresses at the brazing interface 509B upon impact. The shank assembly 303B may be press fitted into the carbide extension 404B before or after the tip 403B is brazed onto the carbide extension 404B.

Figure 6:
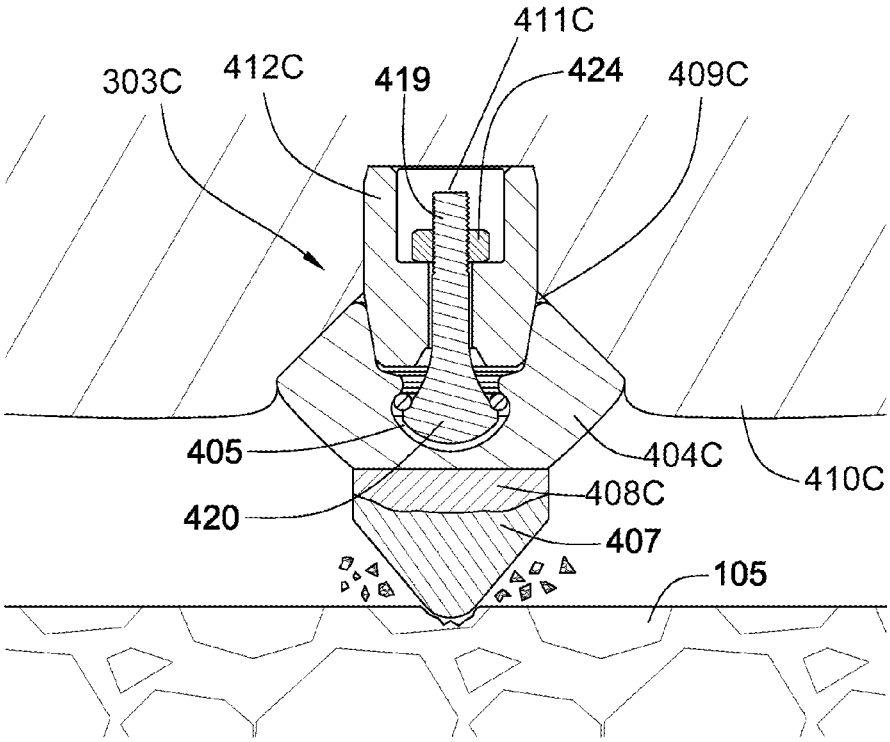
FIG. 6 is a cross-sectional diagram of another embodiment of a degradation assembly.
Figure 7:
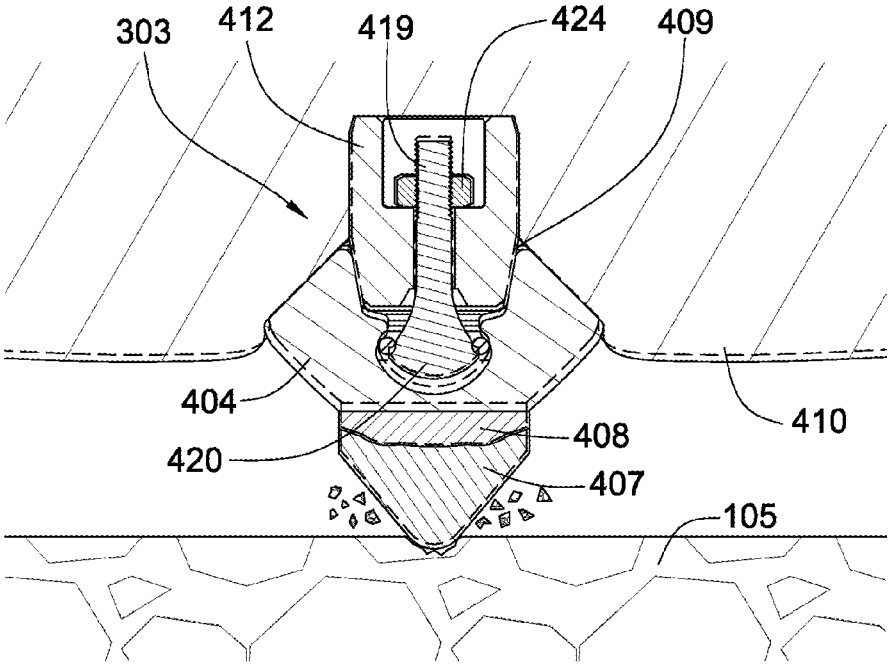
FIG. 7 is a cross-sectional diagram of another embodiment of a degradation assembly.

Referring now to the embodiment of FIGS. 6 through 7, an outer surface 412C of a shank assembly 303C may be press-fit into a recess 409C formed in a driving mechanism 410C. The outer surface 412C of the shank assembly 303C has a coefficient of thermal expansion within 25 percent of a coefficient of thermal expansion of a material of the driving mechanism 410C. It is believed that if the coefficient of thermal expansion of the outer surface 412C within 25 percent the coefficient of thermal expansion of the driving mechanism 410C that the press-fit connection between the outer surface 412C and the driving mechanism 410C will not be compromised as the driving mechanism 410C increases in temperature due to friction or working conditions. In preferred embodiment, the coefficients of thermal expansion are within 10 percent. A locking mechanism 411C may have a coefficient of thermal expansion equal to or less than the coefficient of thermal expansion of the outer surface 412C. It is believed that if the coefficient of thermal expansion of the locking mechanism are outside of 25 percent that the shank assemblies 303C will loosen their press fit and potentially fall out of the driving mechanism 410C. The benefits of similar coefficients of thermal expansion allow for a more optimized press fit. The carbide substrate 408C may have the same coefficient of thermal expansion as the carbide extension 404C.

Figure 8:
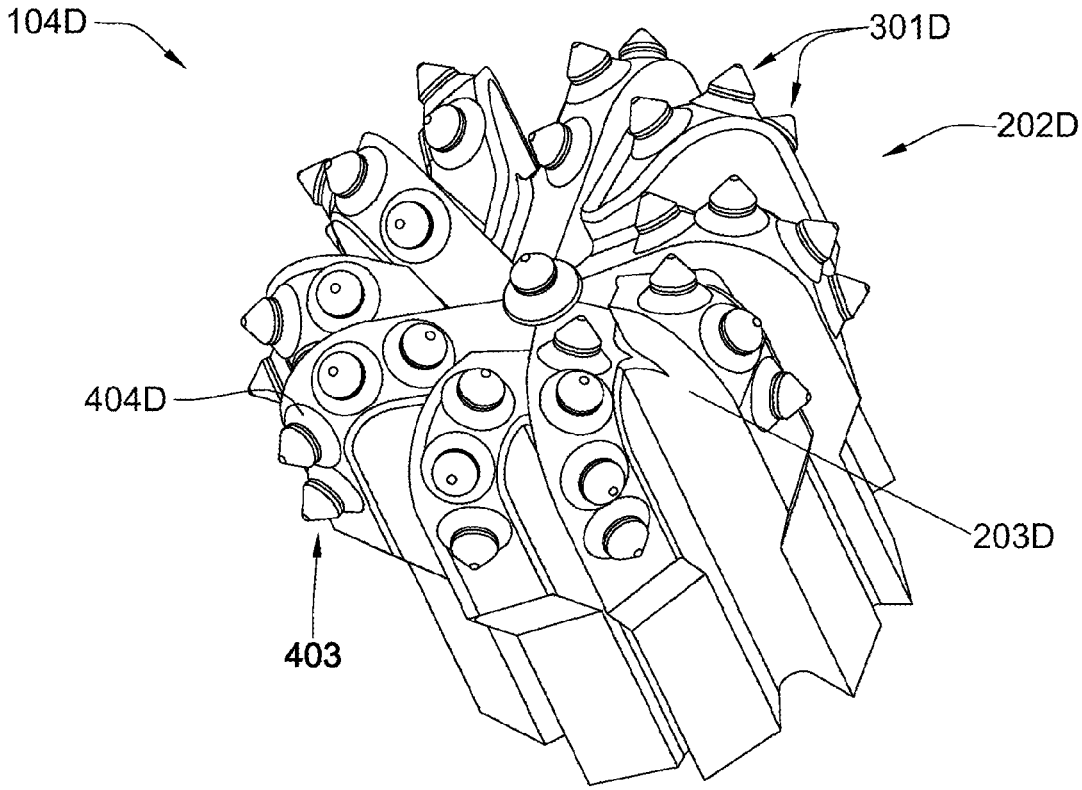
FIG. 8 is a perspective diagram of another embodiment of a rotary drag bit.

FIGS. 8 through 12 disclose various embodiments of a rotary drag bit having at least one degradation assembly. FIG. 8 discloses a rotary drag bit 104D that has 10 blades 203D formed in a working face 202D of the rotary drag bit 104. A cemented metal carbide extension 404D may form a portion of the blades 203D and working face 202D of the bit 104D.

Figure 9:
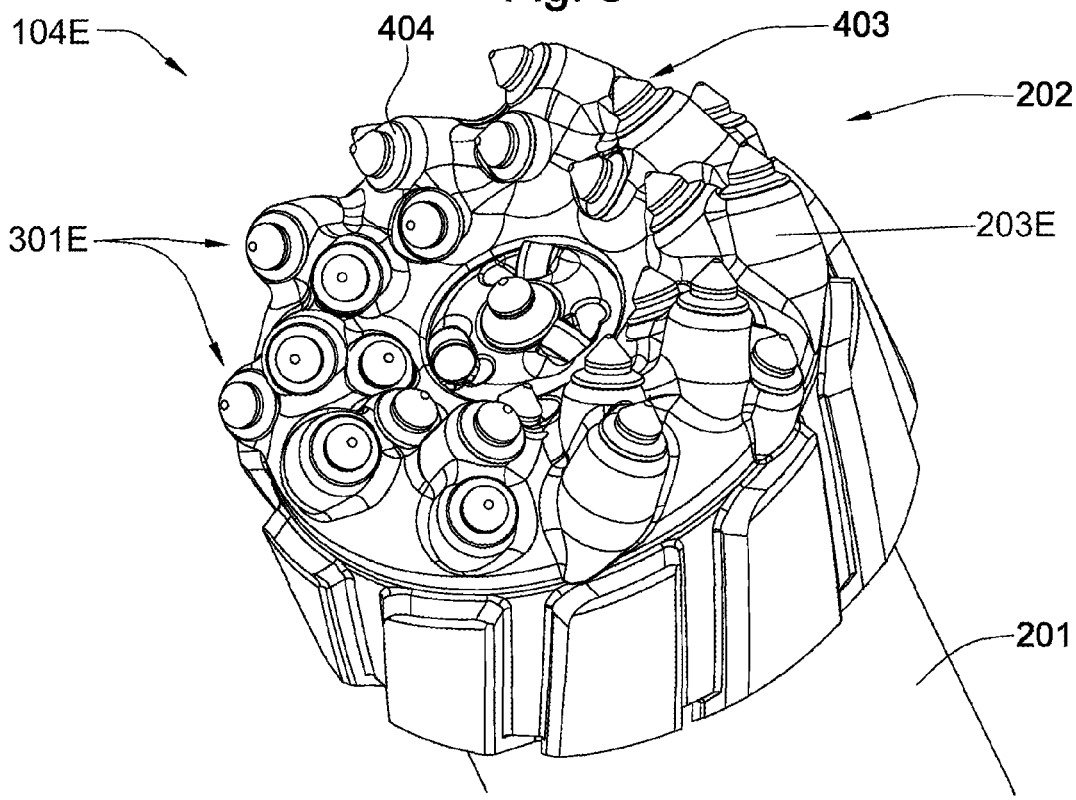
FIG. 9 is a perspective diagram of another embodiment of a rotary drag bit.

In the embodiment of a rotary drag bit 104E of FIG. 9, blades 203E are formed by the degradation assemblies 301E in the working face 202E of rotary drag bit 104E.

Figure 10:
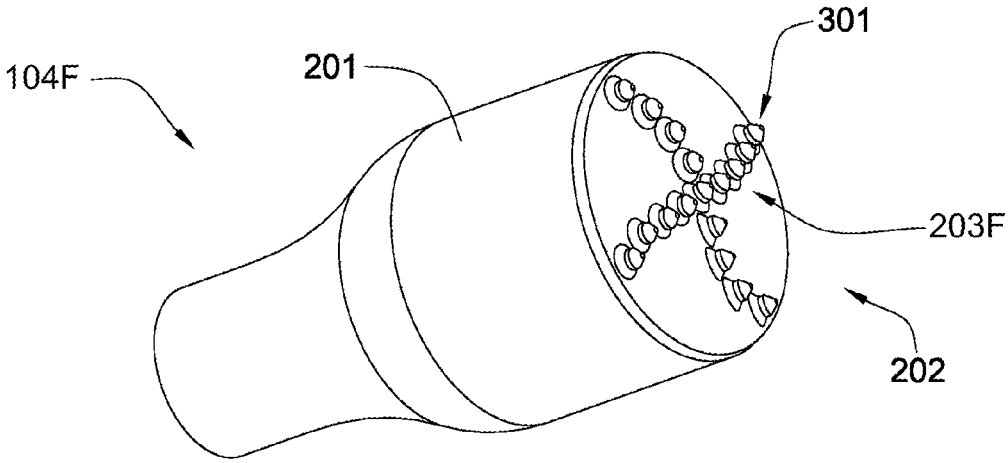
FIG. 10 is a perspective diagram of another embodiment of a rotary drag bit.

In the embodiment of a rotary drag bit 104F of FIG. 10, blades 203F are formed by degradation assemblies 301F in a working face 202F of a drill bit 104F.

Figure 11:
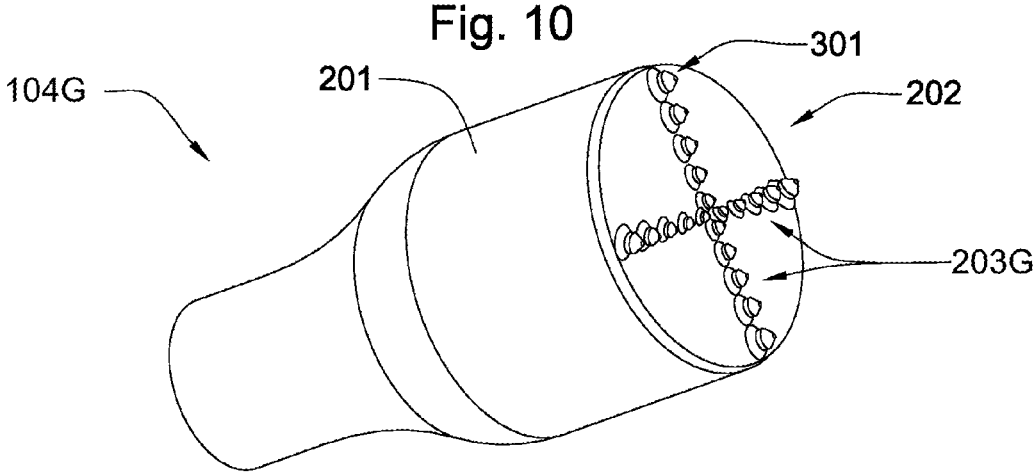
FIG. 11 is a perspective diagram of another embodiment of a rotary drag bit.

In the embodiment of a rotary drag bit 104G of FIG. 11, blades 203G are formed by degradation assemblies 301G in a working face 202G of a drill bit 104G.

Figure 12:
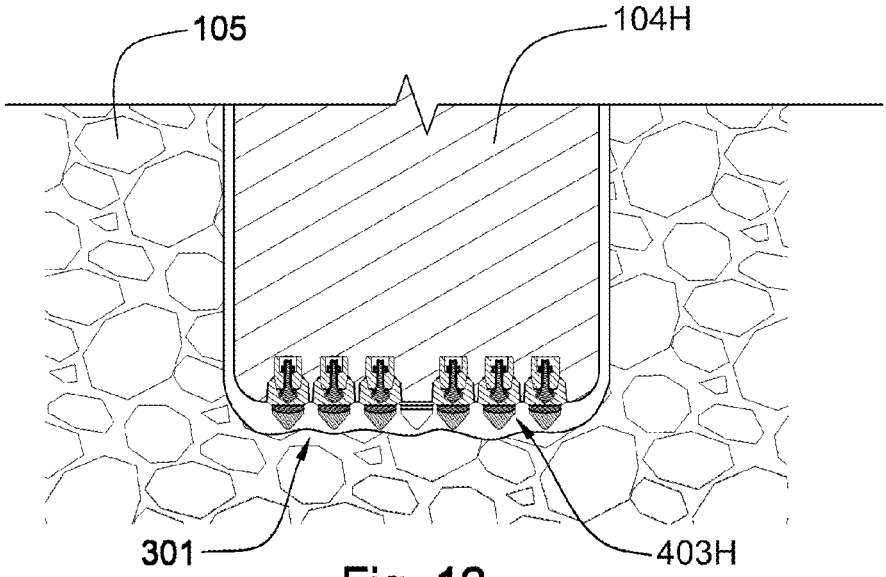
FIG. 12 is a cross-sectional diagram of another embodiment of a rotary drag bit.

In the embodiment of a rotary drag bit 104H of FIG. 12, blades 203H are formed by degradation assemblies 301H in a working face 202H of a drill bit 104H.

The drill bit may also comprise degradation assemblies of varying sizes.

Figure 13:
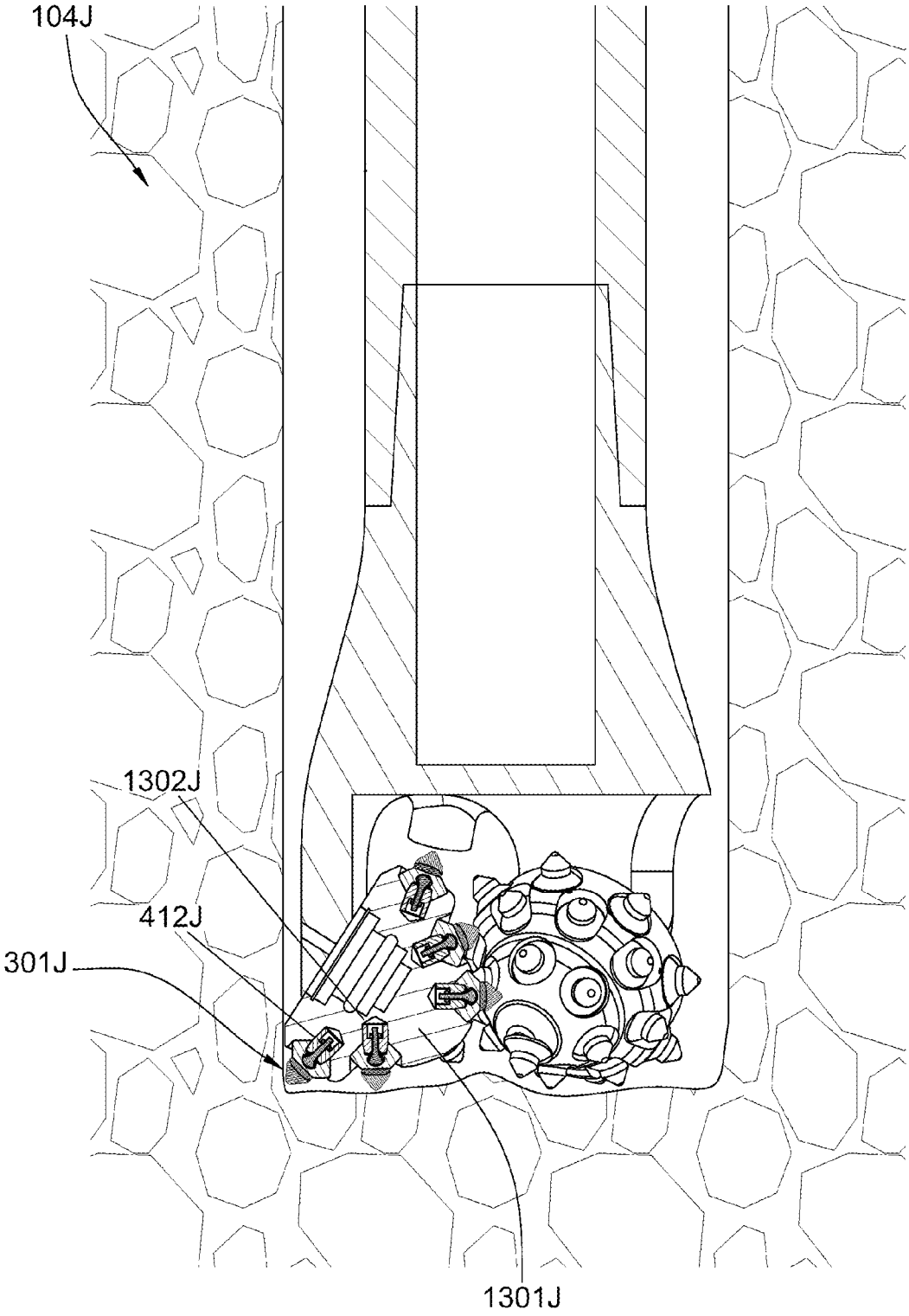
FIG. 13 is a cross-sectional diagram of an embodiment of a roller cone bit.

FIG. 13 discloses an embodiment of a degradation assembly 301J incorporated into a roller cone bit 104J. The outer surface 412J of the degradation assembly 301J may be press-fitted into a recess 1302J formed in the cone 1301J of the roller cone bit 104J. The cone 1301J may include multiple degradation assemblies 301J.

Figure 14:
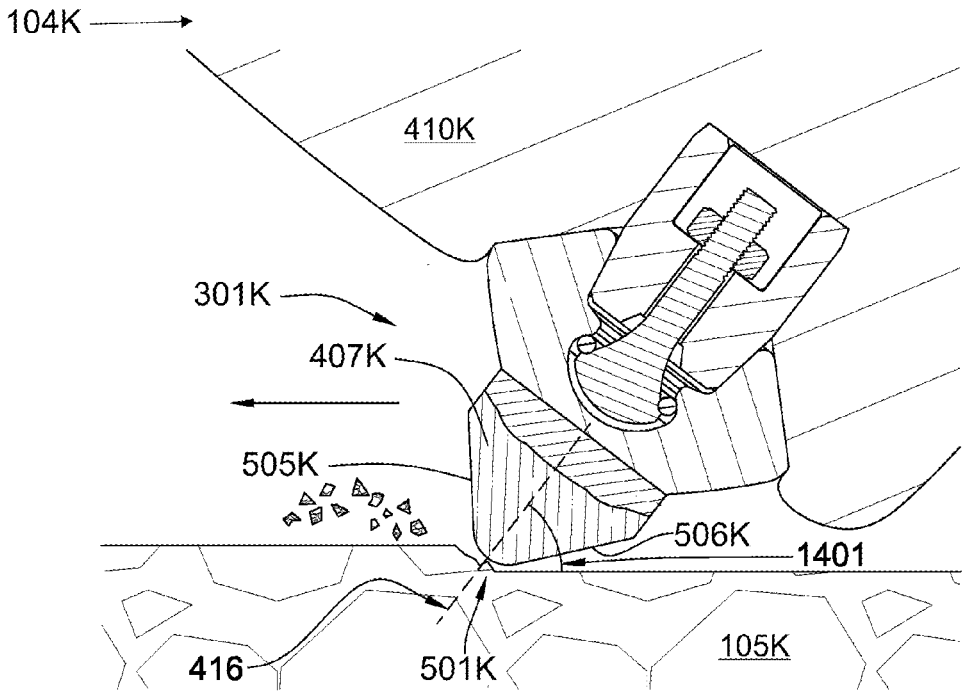
FIG. 14 is a cross-sectional diagram of another embodiment of a degradation assembly.
Figure 15:
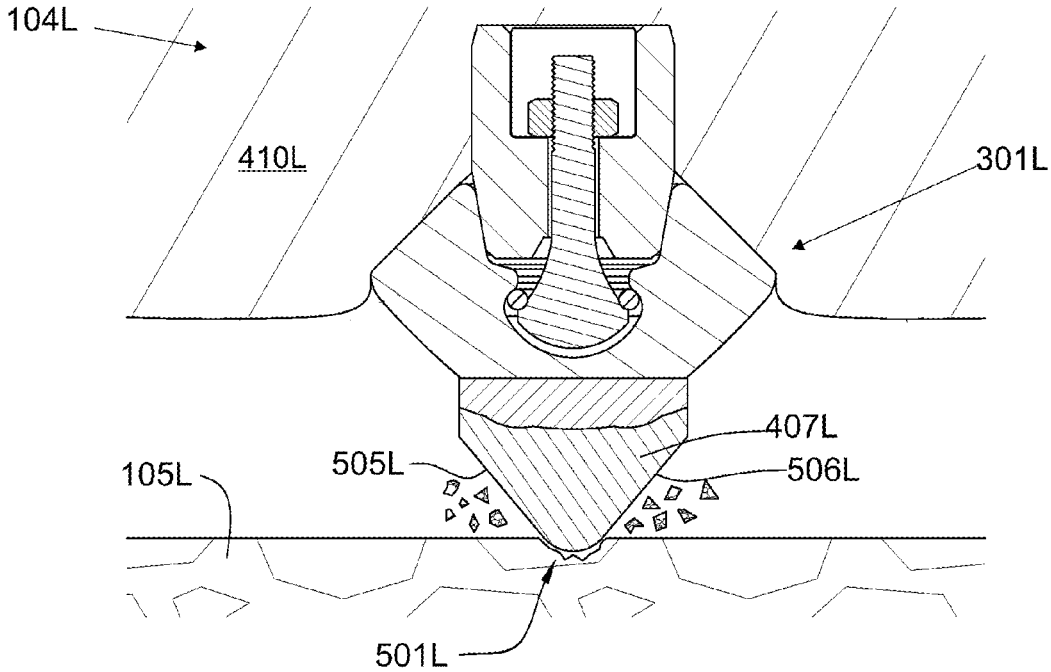
FIG. 15 is a cross-sectional diagram of another embodiment of a degradation assembly.

FIGS. 14 through 15 disclose embodiments of a degradation assembly 301K, 301L contacting a formation 105K, 105L. The degradation assemblies 301K, 301L may be positioned on a driving mechanism 410K, 410L such that an apex 501K, SOIL of the superhard material 407K, 407L engages the formation 105K, 105L and the sides 505K, 505L, 506K, 506L of the superhard material 407K, 407L do not engage or contact the formation 105K 105L. The degradation assemblies 301K, 301L may be positioned on the driving mechanism 410K, 410L such that the apex 501K SOIL of the superhard material 407K, 407L engages the formation 105K, 105L and no more than 10 percent of the sides 505K, 505L, 506K 506L of the superhard material 407K, 407L engages or contacts the formation 105K, 105L. It is believed that the working life of the degradation assembly 301K, 301L may be increased as contact between the sides 505K 505L, 506K 506L of the superhard material 407K, 407L and the formation 105K 105L is minimized. FIG. 14 discloses an embodiment of the degradation assembly 301K adapted to a rotary drag drill bit 104K where the apex 501K contacts the formation 105K at an angle 1401 with the central axis 416K. The angle 1401 may always be larger than half the included angle discussed in FIG. 5. FIG. 15 discloses an embodiment of the degradation assembly 301L adapted to a roller cone bit 104L.

Figure 16:
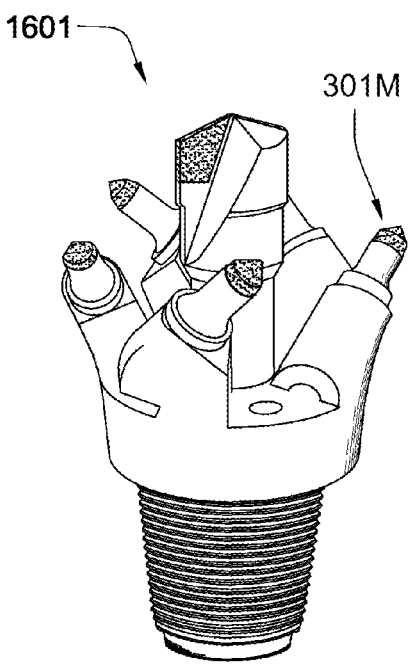
FIG. 16 is a perspective diagram of an embodiment of a drill bit.
Figure 17:
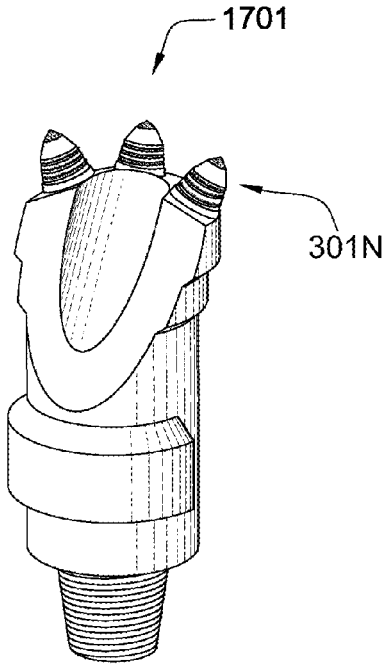
FIG. 17 is a cross-sectional diagram of another embodiment of a drill bit.
Figure 18:
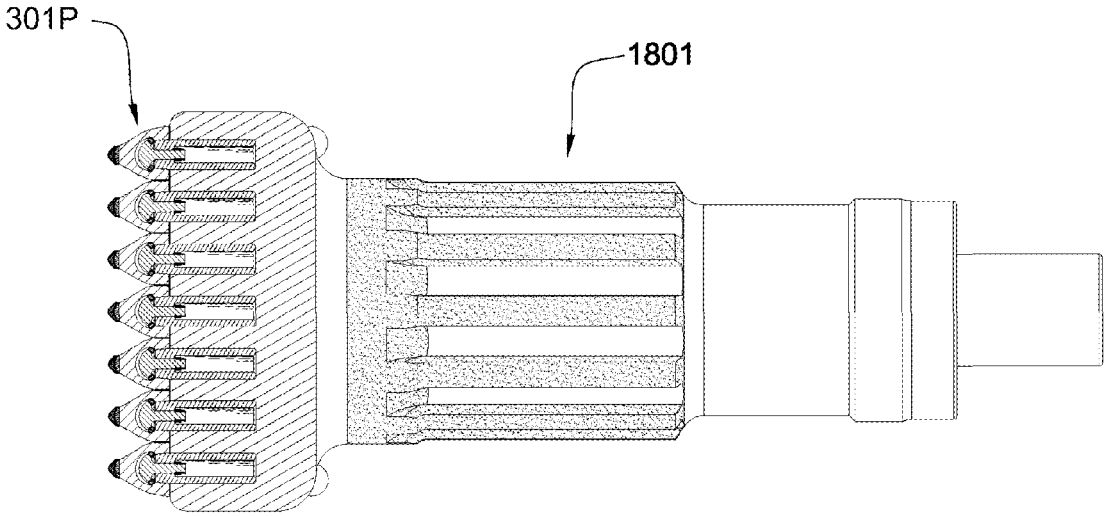
FIG. 18 is a cross-sectional diagram of an embodiment of a percussion bit.

FIGS. 16-18 disclose various wear applications that may be incorporated with the present invention. FIG. 16 discloses a drill bit 1601 typically used in water well drilling having degradation assemblies 301M. FIG. 17 discloses a drill bit 1701 typically used in subterranean, horizontal drilling having degradation assemblies 301N. FIG. 18 discloses a percussion bit 1801 typically used in downhole subterranean drilling having degradation assemblies 301P. These bits 1601, 1701, 1801 and other bits may be consistent with the present invention.

Figure 19:
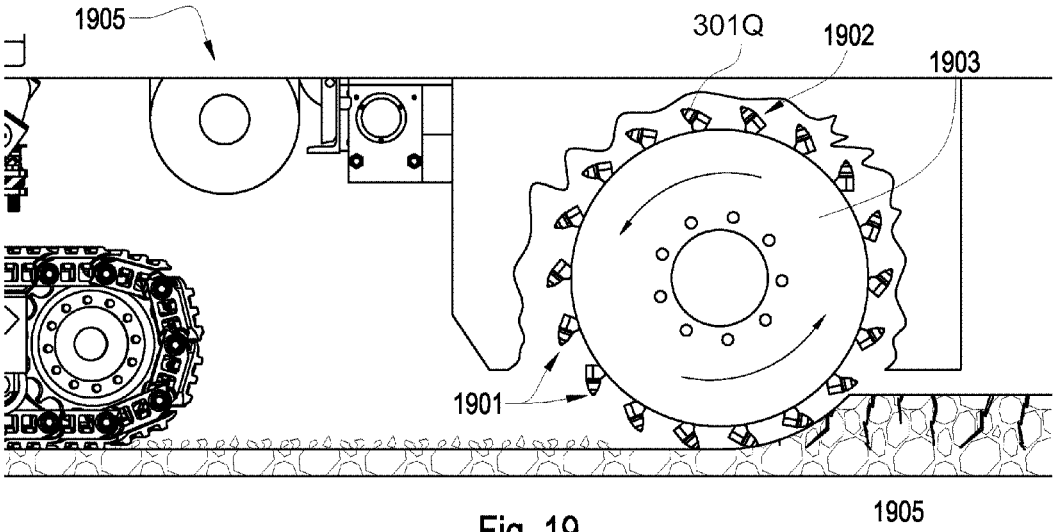
FIG. 19 is a cross-sectional diagram of an embodiment of a milling machine.
Figure 20:
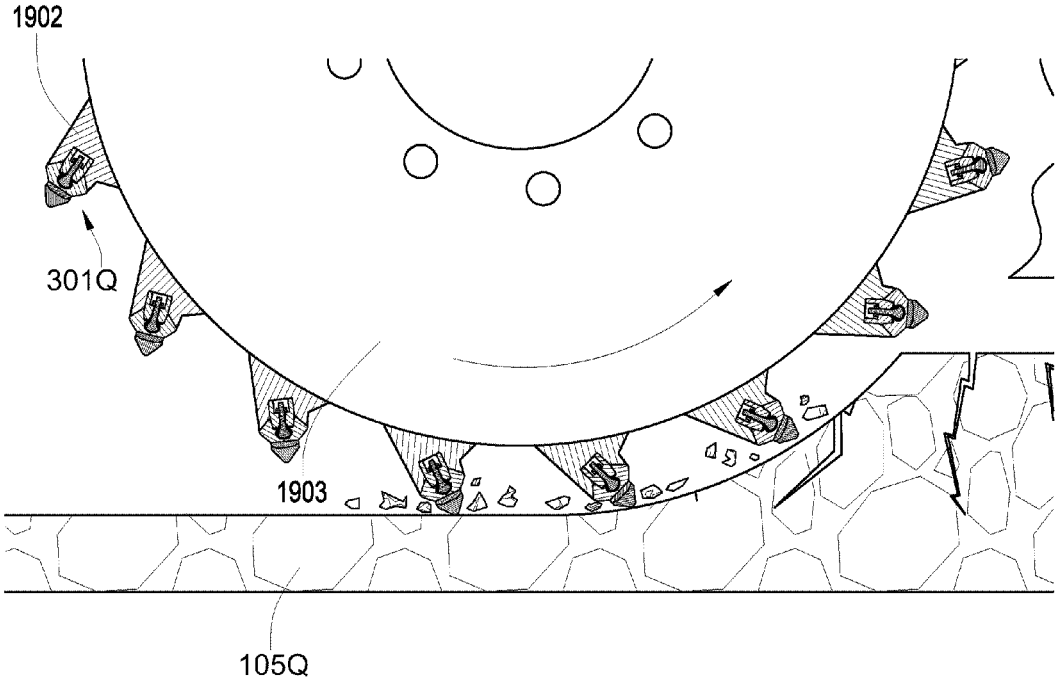
FIG. 20 is a cross-sectional diagram of an embodiment of a milling machine drum.

Referring now to FIGS. 19 through 20, a degradation assembly 301Q may be incorporated into a plurality of picks 1901 attached to a rotating drum 1903 that may be connected to the underside of a pavement milling machine 1905. The milling machine 1905 may be a cold planer used to degrade a manmade formation 105Q such as a paved surface prior to the placement of a new layer of pavement. Picks 1901 may be attached to a driving mechanism 1903 bringing the picks 1901 into engagement with the formation 105Q. A holder 1902, which may be a block, an extension in the block or a combination thereof, is attached to the driving mechanism 1903, and the pick 1901 is inserted into the holder 1902. The holder 1902 may hold the pick 1901 at an angle offset from the direction of rotation, such that the pick 1901 engages the pavement at a preferential angle. Each pick 1901 may be designed for high-impact resistance and long life while milling the paved surface 105Q. A pick that may be compatible with the present invention is disclosed in U.S. patent application Ser. No. 12/020,924 to Hall and is currently pending. The degradation assembly 301Q may also be incorporated in mining picks, trenching picks, excavating picks or combinations thereof.

Whereas the present invention has been described in particular relation to the drawings attached hereto, it should be understood that other and further modifications apart from those shown or suggested herein, may be made within the scope and spirit of the present invention.

What is claimed is:

1. A high impact resistant tool tip, comprising:

a cylindrical cemented metal carbide substrate having a first volume, a central axis, a base surface, a non-planar upper surface opposing said base surface, a cylindrical rim, and a substrate thickness between said base surface and said upper surface, said non-planar upper surface tapering from said cylindrical rim towards said central axis; and a superhard material bonded to said upper surface, said superhard material having a conical geometry with a second volume greater than said first volume, an apex at a distal end of said superhard material, an interface surface opposing said apex, said interface surface being complementary to said non-planar upper surface, and an apex thickness between said apex and said interface surface, said apex thickness being at least 1.5 times as great as said substrate thickness.

2. The high impact resistant tool tip of claim 1, wherein said superhard material is selected from the group consisting of diamond, polycrystalline diamond, natural diamond, synthetic diamond, vapor deposited diamond, silicon bonded diamond, cobalt bonded diamond, thermally stable diamond, polycrystalline diamond with a binder concentration of 1 to 20 weight percent, infiltrated diamond, layered diamond, monolithic diamond, polished diamond, course diamond, fine diamond, cubic boron nitride, diamond impregnated matrix, diamond impregnated carbide, and metal catalyzed diamond.

3. The high impact resistant tool tip of claim 1, wherein said superhard material comprises infiltrated diamond.

4. The high impact resistant tool tip of claim 1, wherein said superhard material has a metal catalyst concentration of less than 5 percent by volume.

5. The high impact resistant tool tip of claim 1, wherein said superhard material has an average diamond grain size of between 1 micron and 100 microns.

6. The high impact resistant tool tip of claim 1, wherein said second volume is between 75% and 175% of said first volume.

7. The high impact resistant tool tip of claim 1, wherein said apex thickness is between 0.190 inch and 0.290 inch.

8. The high impact resistant tool tip of claim 1, wherein said apex thickness and said substrate thickness have a total thickness between 0.200 inch and 0.500 inch.

9. The high impact resistant tool tip of claim 1, wherein said apex has a radius between 0.650 inch and 0.950 inch.

10. The high impact resistant tool tip of claim 1, wherein the high impact resistant tool tip is incorporated in drill bits, shear bits, percussion bits, roller cone bits or combinations thereof.

11. The high impact resistant tool tip of claim 1, wherein said apex of said conical geometry has an included angle between 50 degrees and 80 degrees.

12. The high impact resistant tool tip of claim 11, wherein said apex has an included angle and said tool has a total thickness between said apex and said base surface, wherein said tool has a ratio between said included angle and said total thickness between 160 degrees per inch and 280 degrees per inch.

13. The high impact resistant tool tip of claim 11, wherein said apex has an included angle, wherein said tool has a ratio between said included angle and said apex thickness between 240 degrees per inch to 440 degrees per inch.

14. The high impact resistant tool tip of claim 1, wherein said superhard material is leached of a catalyzing material to a depth no greater than at least 0.5 mm from said working surface of said superhard material.

15. The high impact resistant tool tip of claim 14, wherein a depth of at least 1 mm from said working surface has a catalyzing material concentration of between 5 percent and 0.1 percent by volume.

16. The high impact resistant tool tip of claim 1, wherein said apex thickness is at least 2 times said substrate thickness.

17. The high impact resistant tool tip of claim 1, wherein said superhard material comprises a monolayer of diamond.

18. The high impact resistant tool tip of claim 1, wherein said cemented metal carbide substrate is brazed to an extension.

* * * * *